US007964133B2

(12) United States Patent
Cappelle et al.

(10) Patent No.: US 7,964,133 B2
(45) Date of Patent: Jun. 21, 2011

(54) METHOD, DEVICE AND ACCESSORIES FOR MANUFACTURING LAMINATE FLOOR PANELS BY USING A PRESS

(75) Inventors: Mark Cappelle, Staden (BE); Christof Vandevoorde, Machelen Zulte (BE)

(73) Assignee: Flooring Industries Limited Sarl, Bertrange (LU)

( * ) Notice: Subject to any disclaimer, the term of this patent is extended or adjusted under 35 U.S.C. 154(b) by 145 days.

(21) Appl. No.: 11/921,555

(22) PCT Filed: Jun. 2, 2006

(86) PCT No.: PCT/IB2006/001892

§ 371 (c)(1),
(2), (4) Date: Dec. 5, 2007

(87) PCT Pub. No.: WO2006/136949

PCT Pub. Date: Dec. 28, 2006

(65) Prior Publication Data

US 2009/0078129 A1 Mar. 26, 2009

(30) Foreign Application Priority Data

Jun. 6, 2005 (BE) ..... 2005/0287

(51) Int. Cl.
*B44C 5/04* (2006.01)
*B44C 3/08* (2006.01)

(52) U.S. Cl. ..... 264/293; 264/160; 156/220

(58) Field of Classification Search ..... 264/220, 264/293, 119, 157, 160; 425/183, 193; 156/219, 156/220

See application file for complete search history.

(56) References Cited

U.S. PATENT DOCUMENTS

| | | | | |
|---|---|---|---|---|
| 2,672,176 | A | 3/1954 | Lyijynen | |
| 3,661,688 | A * | 5/1972 | Wheeler | 428/54 |
| 4,544,440 | A | 10/1985 | Wheeler | |
| 5,647,934 | A | 7/1997 | Vaders et al. | |
| 6,465,046 | B1 | 10/2002 | Hansson et al. | |
| 2003/0147986 | A1 * | 8/2003 | Correia | 425/353 |

FOREIGN PATENT DOCUMENTS

| | | |
|---|---|---|
| DE | 31 05 236 | * 9/1982 |
| DE | 103 19 432 | 4/2003 |
| EP | 0 095 046 | 11/1983 |
| EP | 0 345 790 | 12/1989 |
| FR | 2 680 726 | 3/1993 |
| WO | WO 97/47834 | 6/1997 |
| WO | WO 01/98603 | 6/2001 |
| WO | WO 01/96689 | 12/2001 |
| WO | WO 2005/046987 | 5/2005 |

OTHER PUBLICATIONS

Derwent abstract and English Machine Translation of DE 103 19 432, of record.*

Derwent abstract and English Machine Translation of DE 103 19 432. Apr. 29, 2003. Hageboke, Frank.*

* cited by examiner

*Primary Examiner* — Richard Crispino
*Assistant Examiner* — Robert Dye
(74) *Attorney, Agent, or Firm* — Bacon & Thomas, PLLC

(57) ABSTRACT

A method for manufacturing floor panels, wherein one starts from board-shaped elements that are subjected to a press treatment, wherein during pressing at the decorative side of the board-shaped elements to be pressed, a press element is used having a plurality of separately formed press parts.

22 Claims, 15 Drawing Sheets

METHOD, DEVICE AND ACCESSORIES FOR MANUFACTURING LAMINATE FLOOR PANELS BY USING A PRESS

This invention relates to a method, a device and accessories for manufacturing floor panels.

FIELD OF THE INVENTION

More particularly, it relates to a method for manufacturing floor panels, wherein one starts from board-shaped elements that are subjected to a press treatment, wherein in particular this press treatment is co-determining for the appearance of the finally obtained floor panels.

Still more particularly, the invention relates to a method for manufacturing laminate floor panels, and in particular laminate floor panels of the type, wherein the board-shaped element from which is started, more particularly the laminate board of which the floor panels are formed, is manufactured by means of a short press cycle, in German denominated by the term "Kurztakt". Primarily, however, not limiting, hereby in particular the production of laminate floor panels of the type is intended wherein resin-treated material webs or resin-treated material sheets are pressed upon a substrate.

BACKGROUND OF THE INVENTION

An important field of application, in which the invention shows itself to its best advantage, is the production of laminate floor panels of the DPL type (Direct Pressure Laminate). Such floor panels mostly are realized by first producing large board-shaped elements of DPL and subsequently sawing those to form floor panels, which then are provided with coupling profiles at their edges. As is known, the board-shaped elements of DPL generally are realized by mutually consolidating, on the one hand, one or more resin-treated material sheets, amongst which a printed decor layer, and, on the other hand, a substrate, whether or not formed of several layers or parts, by means of a press treatment, under the influence of pressure and temperature.

As further will become clear from the following description, the invention also shows itself to its best advantage in applications, wherein, during performing the press treatment, impressions are also formed in the decorative side of the board-shaped material, which have to be in register with the applied decor. This technique, which is called "embossed in register", is known, amongst others, from the patent document WO 01/96689.

When producing the aforementioned floor panels, it is known that, for performing said press treatment, use is made of large press elements, consisting of one-piece press plates, with which the aforementioned board-shaped material is pressed. Mostly, these press plates, which are also called "platens", are having dimensions in the order of magnitude of 2.5×5 meters and a thickness of approximately 0.5 cm or more.

Applying large press plates has the advantage that a rather large surface can be processed in one press treatment, in other words, in one press treatment a board-shaped element can be processed, which is of such dimensions that a plurality of floor panels, mostly 10 to 30, can be made from it. Another advantage of the use of such large press plates consists in that better yields are obtained in respect to the energy consumption for heating the presses than in the case that, for example, smaller plates in smaller presses were applied.

However, the application of the known large press plates also has different disadvantages.

A disadvantage consists in that, when such large press plate is damaged locally, for example, by scratching or the like, it must be replaced completely. Replacing such press plate is rather expensive, on the one hand, because the press plate itself costs a lot, and on the other hand also because of the transport costs, in view of the fact that the production of such large press plates takes place exclusively at specialized companies, which often are situated at distant locations.

Also, due to the fact that up to now such large press plates are produced by specialized companies, the disadvantage is created that the communication between the designer of a decor, who mostly is resident at the floor panel manufacturer's, and the producer of the press plates, who often is situated at a distant location, regularly is quite difficult. In view of the fact that often, the press plates are provided with a relief which must be in register with the decor, a good communication is very important. In order to remedy this disadvantage, one might consider integrating facilities for manufacturing press plates into a production unit for floor panels, such that a smoother communication becomes possible. However, due to the proportions of the known large press plates, expensive equipment is necessary for manufacturing them, for example, for etching the surface of such press plates, and up to now, performing such integration is not worthwhile. In fact, such integrated equipment would be in use only now and then, namely each time a new press plate must be produced, which would only lead to a low yield in respect to the utilization of the equipment and in respect to the input of specialized personnel.

Another disadvantage of such large one-piece press plates consists in that, when these must be provided with a relief, for example, an etched texture or etched pattern, it is rather difficult to perform such texture or such pattern faultless over the entire surface. In the case of an unacceptable deviation, a new press plate must be produced. Also, with large surfaces it is difficult to maintain high resolutions when etching. Moreover, it is difficult to etch large surfaces in a uniform manner. When etching large surfaces, a number of actions still must be performed manually, which requires particular skill.

In the case that one is working with press plates having a relief with which impressions must be realized that have to be in register or approximately in register with a decor present on a decor paper to be pressed or the like, still another disadvantage occurs. With such decor papers, it is known that it is particularly difficult to deliver them with a constant width. During the resin-treatment of the printed material web, more particularly paper width, of which the aforementioned decor paper is formed, this material, paper, respectively, becomes weaker and therefore more extensible. During transport through the resin-applying installation, different forces occur, due to which the paper is stretched somewhat. Up to now, it is particularly difficult to keep this stretching, which manifests itself in the width of the material web more than in the length thereof, precisely under control. This results in that a pattern present in the decor, in function of the stretching that manifests itself, will be more or less widened. As the pattern on a press plate, however, is unalterably fixed, it is clear that, in function of said stretching, the impressed pattern may deviate from the printed pattern to a minor or major extent. In order to exclude major deviations, it is known to produce two or three press plates, each with a relief with a similar pattern or motif, however, differing somewhat in mutual respect in that the patterns or motifs are stretched somewhat more or less, respectively, in respect to each other. In function of each batch of produced material sheets, then the press plate that best matches the decor can be used for pressing. However, it is disadvantageous that manufacturing two or more of such large press plates with mutually more or less stretched relief patterns is quite expensive.

SUMMARY

Primarily, the invention aims at a method for manufacturing floor panels, wherein one starts from board-shaped elements, which are subjected to a press treatment, wherein this method, by applying a particular press element, can be conducted in a more optimized manner, whereas preferably also one or more of the aforementioned disadvantages are excluded, however, preferably also the aforementioned advantages of the use of large press plates are maintained.

To this aim, the invention relates to a method for manufacturing floor panels, wherein one starts from board-shaped elements that are subjected to a press treatment, with as a characteristic that during pressing, at the decorative side of the board-shaped elements to be pressed, a press element is used having a plurality of separately formed press parts.

Due to the fact that according to this method separately formed press parts are applied, a process is obtained that is optimized in several aspects. More particularly, thereby one or more of the advantages mentioned hereafter are obtained, or at least the possibility is provided to create these advantages.

A first advantage consists in that, when such press element becomes locally damaged, for example, by scratching or the like, exclusively the respective or thus damaged press parts must be replaced and, thus, not the complete press element. This can be performed relatively fast and at low cost.

In that a plurality of separate press parts are applied instead of a one-piece large press plate, these press parts as such have a smaller surface, with the advantage that the fabrication of such press part, due to the smaller surface, may take place in a better controlled manner. Also, such small press parts are better suited for applying fine manufacturing techniques, such as refined etching processes, milling processes and the like thereto. In this manner, relief patterns with higher resolutions are easy to establish. If a mistake is made when a press part is realized, exclusively this press part must be produced again, which, in view of the minor extent thereof, will bring about a relatively restricted cost.

Also, such press parts smoothly allow to perform tests with new press patterns, in view of the fact that only a relatively small relief pattern must be worked out, namely, of the size of such press part.

When portions of a decor must be adapted during the development phase or thereafter, whereas a matching press element has already been manufactured, it is no longer necessary to produce an entire press element again, however, it suffices to replace the respective press parts by new press parts, which are adapted to the altered portion of the decor.

Another advantage of the use of such press parts consists in that they can be applied for presses of different formats, wherein then, in function of the format of the press, more or less press parts can be provided on, for example, a common basic element.

For producing said press parts, smaller and therefore also cheaper machines can be employed than in the case that traditional large platens are produced. Hereby, a manufacturer of floor panels can acquire the respective technology more easily to have it on site, or he also obtains the possibility of addressing himself to etching companies that are specialized exclusively in etching smaller surfaces.

Also, the use of a plurality of separate press parts allows to smoothly build up several series of press elements necessary to remedy the disadvantages as a result of paper stretching.

It is noted that the use of separate etched press parts, which are attached to a common base element, is already known from U.S. Pat. No. 4,544,440. Herein, however, a press part for a mould press is concerned, which is intended for realizing a certain shape from a mass of wood particles. This known technique is situated in an entirely different technical field than the formation of laminate panels. Moreover, the shapes, varying extremely in their depth, of the press parts employed according to U.S. Pat. No. 4,544,440 do not allow to apply such press parts in combination with the basic boards traditionally used for manufacturing floor panels, on the one hand, as such boards, which mostly consist of MDF or HDF, are hardly deformable, and on the other hand, as the laminate top layers to be pressed allow only little deformation.

According to a preferred form of embodiment, use is made of a press element, wherein several of the aforementioned press parts, and preferably all press parts, are attached to a base element that is common to several press parts. This allows to perform the press element as one whole, or in the form of a limited number of wholes, wherein each such whole can be attached in a press in a manner as this now is performed with the known large press plates.

According to a particular form of embodiment, use is made of a press element comprising two or more base elements, at which respectively two or more press parts are provided.

According to a preferred form of embodiment, the press parts are provided at the associated base element in a detachable manner.

According to another preferred form of embodiment, the method is characterized in that use is made of a press element that comprises two or more press parts, wherein the mutual position among two or more of these press parts, or, thus, the location thereof, is adjustable, more particularly, can be regulated. This allows to perform adjustments, for example, in order to take into account, during pressing, the possible stretching in a decor layer to be pressed. In applications where use is made of a press element comprising a base element, one or more of the press parts can be made adjustable or able to be regulated in respect to the pertaining base element.

The location of the press parts can be adjustable by means that allow for a certain fixed adjustment, or by means that allow an adjustment that can be regulated.

According to a preferred form of embodiment, the adjustment can be controlled in function of data derived from a decor layer to be pressed, more particularly data relating to the deformation of the decor as a result of stretching in this decor layer.

Other characteristics of preferred forms of embodiment of the present invention and the advantages obtained thereby will become apparent from the detailed description and the appended claims.

The present invention also relates to a device and accessories for manufacturing floor panels, and more particularly for realizing the aforementioned method, the characteristics of which will become apparent from the further description.

Moreover, the invention of course also relates to floor panels obtained by applying the aforementioned method and device.

Finally, the invention also relates to a method for forming a press element for floor panels, characterized in that the press element is composed at least of several in transverse direction adjacently located, separately formed press parts, wherein at least a number of these press parts are provided with a surface structure for forming impressions in the surface of the floor panels, and wherein the position and dimensions of the press parts are chosen such that each press part corresponds to a decor portion of a floor panel to be realized, or with a multiple of such decor portions, and that for forming the aforementioned surface structure, at least an etching process is applied, wherein for at least a number of the press elements, this etching process is performed on the press parts whilst these are in separately formed condition, such that the etching process is performed on a significantly smaller press part than in the case that a press plate over the entire surface is applied. Etching of such relatively small press part can be realized more smoothly and with higher resolutions than this is the case with large press plates. Moreover, considerably smaller equipment can be employed for etching. The same is valid when, for forming the surface structure, use is made of mechanical machining treatments, for example, by means of milling cutters. There, too, exists the advantage that working can be performed more smoothly and smaller equipment can be employed. So, for example, it is possible to work with less large milling tables.

BRIEF DESCRIPTION OF THE DRAWINGS

With the intention of better showing the characteristics of the invention, hereafter, as an example without any limitative character, several preferred forms of embodiment are described, with reference to the accompanying drawings, wherein.

DETAILED DESCRIPTION OF THE DRAWINGS

Figure 1:
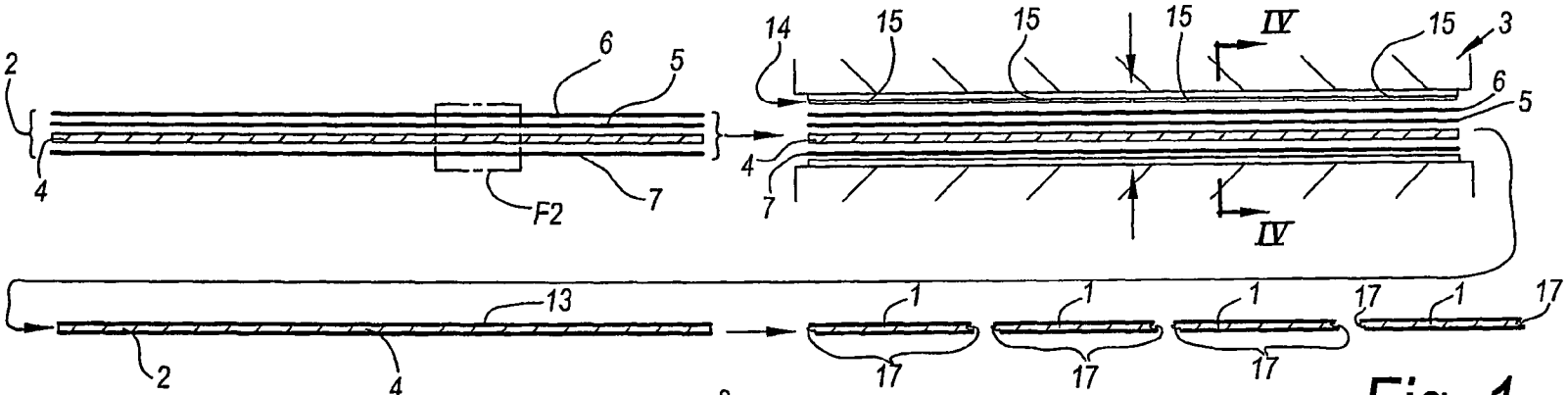
FIG. 1 schematically represents a press with a press element for realizing the method of the invention.

As represented in FIG. 1, the invention relates to a method for manufacturing floor panels 1, wherein one starts from board-shaped elements 2, which are subjected to a press treatment in a press 3.

In the schematically represented example of FIG. 1, the board-shaped elements 2 are performed as DPL (Direct Pressure Laminate) and are the composing layers thereof consolidated to a whole in the press 3. Hereby, the DPL is composed in a known manner of a substrate 4, preferably a MDF or HDF board (Medium Density Fiberboard or High Density Fiberboard), and one or more, in this case three, resin-treated material layers 5-6-7, amongst which a printed decor layer 5.

Figure 2:
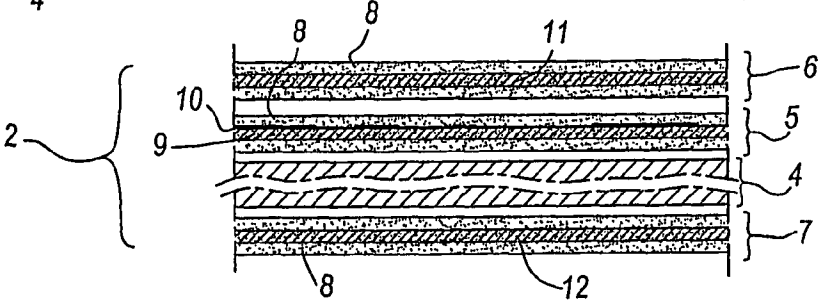
FIG. 2, at a larger scale, represents the portion indicated by F2 in FIG. 1.

For clarity's sake, the layer construction represented in FIG. 1 is shown more detailed in the enlarged view of FIG. 2, wherein the composing layers to be pressed are illustrated spaced apart one above the other. At the upper side of the substrate 4, there are two of said resin-treated material layers, the aforementioned decor layer 5 and the so-called overlay 6, respectively. The decor layer 5 consists of carrier sheet 9, for example, paper, which carrier sheet is provided with resin 8 and is printed with a decor 10. The overlay 6 consists of a carrier sheet 11 also provided with resin 8, for example, white paper, which becomes transparent after pressing. In this overlay 6 preferably hard particles, such as corundum, are incorporated in order to enhance the wear resistance of the final product. At the bottom side of the substrate 4, the third material layer 7 is present, which also consists of a carrier sheet 12 provided with resin 8 and which is intended to function as a backing layer.

Figure 3:
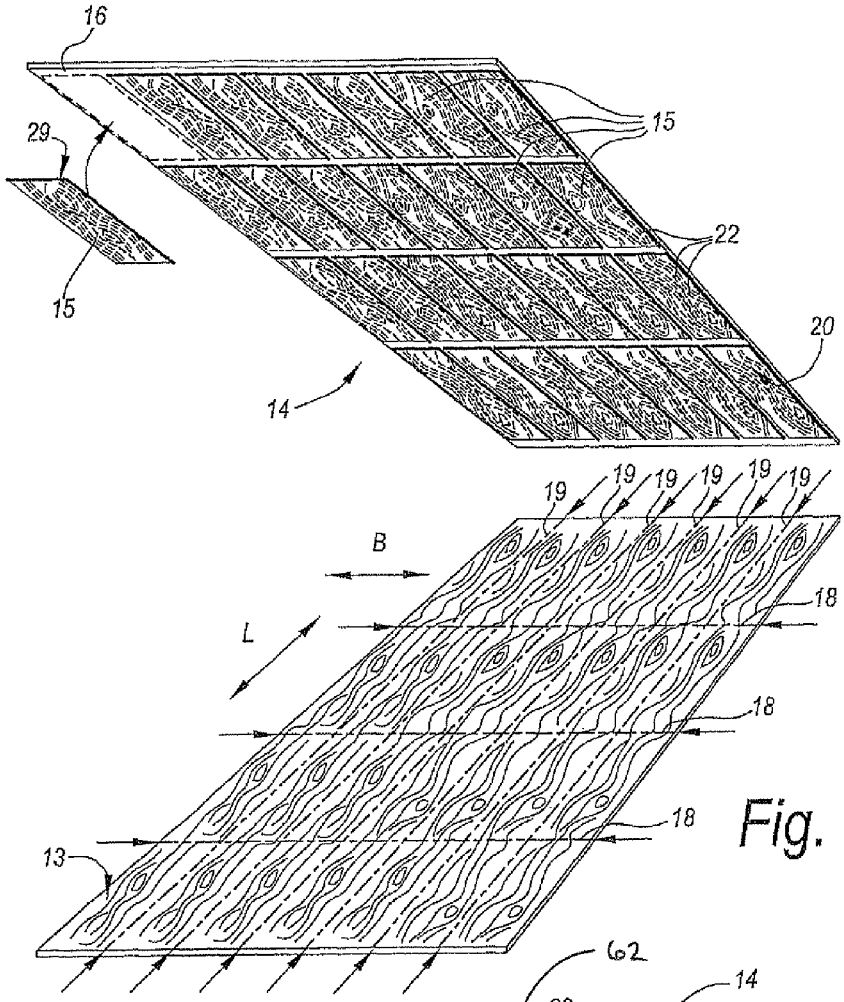
FIG. 3 schematically represents a view of the pressing side of the press element of the press from FIG. 1, together with an already pressed board-shaped element.

The particularity of the invention consists in that during pressing, at the decorative side 13 of the board-shaped elements 2 to be pressed, a press element 14 is used that, as can be seen in FIGS. 1 and 3, does possess a plurality of separately formed press parts 15. Using such separate press parts 15 instead of one large press plate when pressing offers various advantages, in which respect reference is made to the explanation in the introduction.

As represented in FIGS. 1, 3, 4 and 5, the press parts 15, each apart, preferably are made as plate-shaped parts, wherein they, each apart, form a so-called "platen". These plate-shaped parts preferably have a global thickness of less than 5 mm, and preferably a thickness of less than 2 mm, and still better a thickness in the order of magnitude of 1 mm or thinner.

As will become apparent from the schematically represented form of embodiment of FIGS. 1, 3, 4 and 5, preferably use is made of a press element 14, wherein several of said press parts 15, and preferably all of the press parts 15, are attached to a common base element 16. This base element 16, as illustrated, preferably is also plate-shaped in its turn and consists, for example, of a plate comparable to a traditional untreated platen. However, it is clear that such common base element 16 does not necessarily have to be plate-shaped and may also be realized in other forms.

In the case that the base element 16 is made plate-shaped, it is preferred that the press parts 15 simply are provided against the respective side, more particularly underside, of the base element 16, as this also is the case in the schematic representation of FIGS. 1, 3, 4 and 5.

In general, it is so that the press parts 15 can be fixed at the base element 16 in any suitable manner. Consequently, in the schematic representation of FIGS. 1, 3, 4 and 5 no particular attachment means are illustrated. According to a first possibility, the press parts 15 may be attached against the base element 16 by means of a glue or the like, for example, with a metal glue, adhesive paste or the like. According to a second possibility, use can be made of mechanical attachment means, such as screws or clamps, a practical embodiment of which will be described further. According to still other possibilities, the press parts 15 can be held to the base element 16 by means of magnetic forces or by suction by means of vacuum. Other techniques, for example, the use of welding connections, are not excluded. Also, combinations of the possibilities sketched above may be applied.

According to an important preferred form of embodiment of the invention, the press parts 15 are provided at the respective base element 16 in a detachable manner, with as advantages that they are replaceable and/or exchangeable and possibly repositionable. By detachable is meant that they can be removed from the base element 16, after which the base element 16 and/or the press parts 15 still remain re-usable. For a glue connection, this means that it allows, for example, that the press parts 15 can be pried loose or steeped loose from the base element 16, such that the base element 16 and/or the press parts 15 are not damaged and thus can be re-used. Preferably, the detachability however will be realized via means allowing for detachment in a non-destructive manner, more particularly mechanical means, such as screws, clamps or the like, or a magnetic fixation or fixation by suction under vacuum. As with such forms of attachment, when detaching the press parts, no destructive actions must be taken, such as disrupting glue connections, welding connections or the like, the risk of irreversibly damaging the press parts and/or the base element becomes almost nihil.

Apart from the fact that a press element 14 is used having a plurality of separate press parts 15, the method for manufacturing the floor panels 1 moreover can be conducted in a known manner. More specifically, this means that, after pressing the board-shaped elements 2, wherein the substrate 4 and the aforementioned material layers 5-6-7 are consolidated, these board-shaped elements 2, by means of one or more sawing procedures, are sawn to floor panels 1, after which at the obtained edges of these floor panels 1, coupling means 17 are provided, for example, by means of a milling treatment or in any other manner. The sawing of the board-shaped elements 2 to floor panels 1 is schematically represented in FIG. 3 by means of saw lines 18-19, in the width direction B and the longitudinal direction L, respectively. A possible form of embodiment of the coupling means 17 to be realized is indicated in dashed line in FIGS. 4 and 5. Preferably, these coupling means 17 are of the type providing a vertical and a horizontal locking when two of such floor panels 1 are coupled to each other. Examples of such coupling means 17 are well known from prior art and are described, for example, in the patent documents WO 97/47834 and WO 01/98603.

The aforementioned press parts, irrespective of their other characteristics, can be provided at their pressing side with a relief formed by unevennesses or projections, in order to thereby form, during pressing, impressions in the upper side of the board-shaped elements 2. The use of press elements with a relief for forming impressions in the board-shaped elements 2 is known as such, however, as explained in the introduction, the invention is shown to its best advantage in particular with this application. For the advantages connected to the use of a plurality of small, separately formed press parts in the case that also a relief must be formed in the board-shaped elements, thus reference is made to the introduction.

The relief in its turn may be of different nature, such in function of the impressions intended to be formed.

Figure 4:
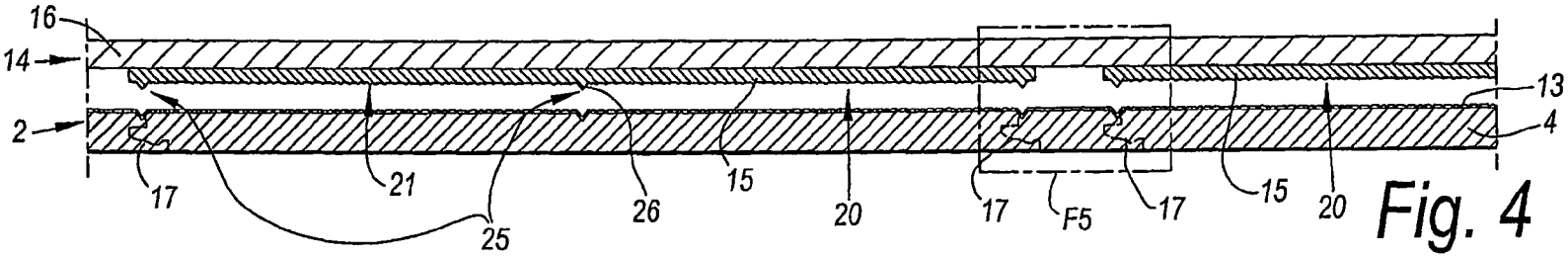
FIG. 4, at a larger scale, represents a cross-section according to line IV-IV in FIG. 1, however, exclusively of the press element and an already pressed board-shaped element.
Figure 5:
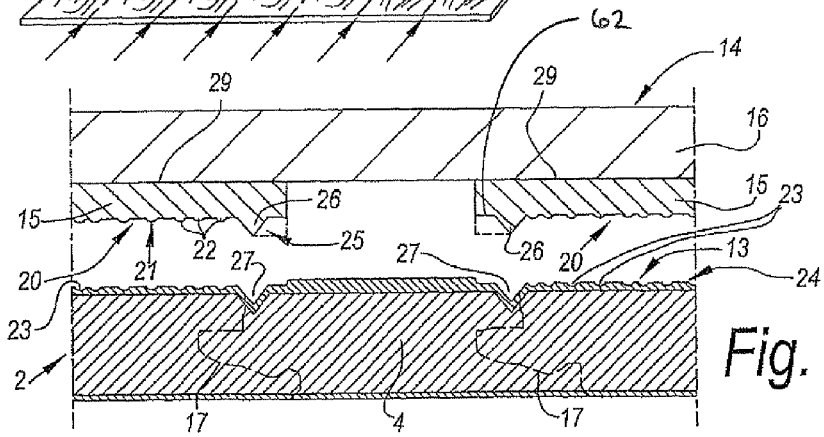
FIG. 5, at a larger scale, represents the portion indicated by F5 in FIG. 4.

In FIGS. 4 and 5, as an example, two relief forms at the pressing sides 20 of the press parts 15 are represented.

Herein, a first relief 21 consists of unevennesses or projections 22, which, during pressing, realize impressions 23 forming a relief 24 in the surface of the pressed product, said relief imitating the natural surface of wood. Herein, the obtained impressions 23 are such that they imitate the pores and/or nerves of wood.

A second relief 25, which is illustrated in FIGS. 4 and 5, is formed of unevennesses or projections 26, which, during pressing, form impressions 27 imitating removed material portions or deformed portions. In the example, this relates to unevennesses 26 with which grooves are impressed into the surface of the board-shaped elements 2 in order to thereby obtain, as illustrated, chamfers or the like.

The press part 15 includes an overhang portion 62 located adjacent an end of the press part 15. The overhang portion 62 extends beyond a corresponding edge of a saw line 18, 19 of a board shaped element outside of the board shaped element 2.

It is clear that the application of a relief is not limited to the examples shown in FIGS. 4 and 5.

So, for example, also reliefs, unevennesses, respectively, can be applied that imitate the natural and/or typical surface of other materials than wood, such as, for example, the surface of stone, ceramics or the like. When imitating certain kinds of stone, such as slate, these unevennesses also may be made terrace-shaped in order to imitate, for example, the flaky surface of such kinds of stone.

Also, almost microscopically small unevennesses can be provided at the pressing side 20 of the press parts 16, which, as known, are applied in order to impart a matte appearance to the laminate surface, or certain parts thereof, by pressing.

Also, a relief can be applied with unevennesses that are intended to leave, after pressing, impressions in the pressed product, which imitate scraped-off material parts, for example, for manufacturing laminated floor panels imitating so-called scraped wood.

As set forth in the introduction, the invention is shown to its best advantage when pressing board-shaped elements 2 having a decor 10 and wherein the relief provided in the board-shaped elements 2, for example, relief 24, must be realized in register or substantially in register with the decor 10.

Figure 6:
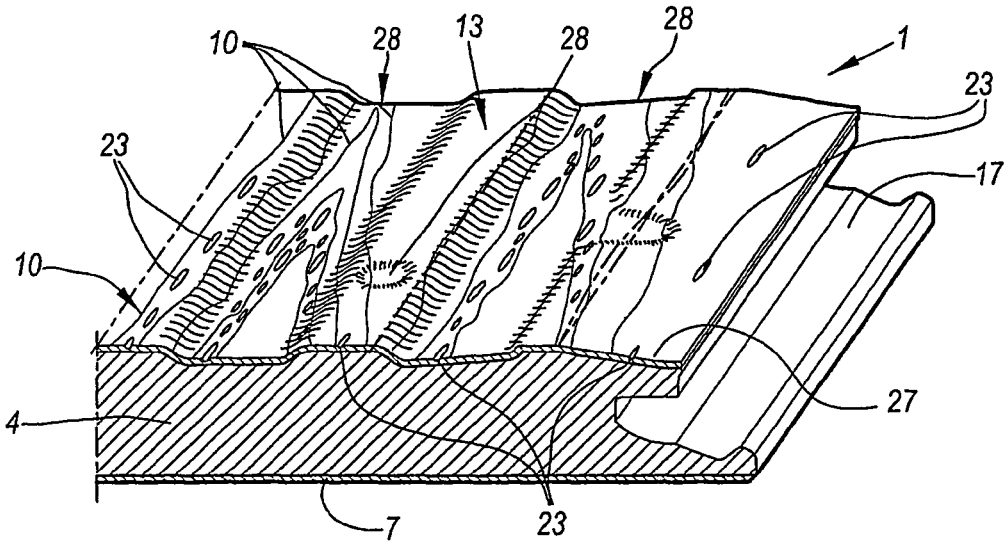
FIG. 6 represents a portion of a floor panel that is realized according to the method of the invention.

Finally, for clarity's sake, in FIG. 6 a portion of a floor panel 1 is represented, which is realized according to the invention and in which various of the above-described characteristics relating to the formed relief are applied. Herein, the printed decor 10 represents a drawing of a wood pattern. By applying a suitable relief at the press parts used in manufacture, small impressions 23 imitating pores, as well as larger impressions 28 imitating scraped-off material, as well as impressions 27 with which a sloping edge portion is formed, are formed in the surface.

Preferably, the height differences in the relief that is applied at the pressing side 20 of the press parts 15 are smaller than 1 mm.

The reliefs, for example, 21 and 25, that are applied in the pressing side 20 of the press parts 15, preferably are realized by removing material portions from the plane of the respective pressing side 20. According to a variation, however, it is not excluded to form the relief at least partially in another manner, for example, by depositing material onto the respective surface or by locally deforming the press parts 15.

Preferably, use is made of press parts 15, wherein the relief present thereon is realized at least partially by means of an etching process, for example, the relief for imitating pores and wood nerves. The application of separate press parts 15 in combination with the application of an etched surface in practice offers various advantages, to which end reference is made to the explanation in the introduction.

The fact that small press parts are used, allows, amongst others, to etch these separately, which makes them very suitable for applying digital etching techniques, wherein the surfaces to be etched, for example, are provided with digital prints in order to realize covering layers during the etching process.

The above does not exclude that performing a relief in the pressing side 20 of a press part 15 by removing material portions may also be realized in other manners. So, for example, may a relief, or at least a part thereof, be formed by a mechanical treatment, for example, a machining treatment, and more specifically a milling treatment, for example, by means of a round-headed milling cutter or, for example, by means of engraving. Due to the fact that use is made of separate press parts 15, which in their turn are relatively small, the advantages are created that tools of relatively small dimensions can be applied, more particularly with a relatively small working table surface, and that less heavy control programs can be applied, in view of the fact that only a relatively small surface must be realized at a time. The use of machining tools, such as milling cutters, is particularly useful when forming larger unevennesses, thus, for forming larger impressions in the board material to be pressed, such as, for example, impressions intended for imitating so-called scraped wood in laminate.

Although, as aforementioned, at least one of the aforementioned etching treatments and/or at least one of the mechanically machining treatments preferably are realized when this press part 15 is in a separate condition, it is not excluded to proceed otherwise. According to a variation of the invention, thus also a method can be applied that is characterized in that the press parts are provided with a relief by means of one or more etching treatments and/or one or more mechanically machining treatments, wherein, at least for one of the press parts, at least one of these etching treatments and/or at least one of these mechanical machining treatments is realized when this press part still forms part of a one-piece larger whole, from which subsequently several press parts are formed. The advantage herein is that several press parts together, in one treatment, are provided at least with a portion of the relief. A disadvantage, however, is that larger equipment and often also heavier control programs are necessary.

Generally, according to the invention preferably press parts 15 are used, the pressing side 20 of which, with the exclusion of local projections or unevennesses, such as the unevennesses 22 and 26, for forming a relief in the product to be pressed, has a globally flat surface, as can also be seen in FIGS. 4 and 5.

Preferably, the press parts 15 have a globally flat rear side 29, such in consideration of a good contact with the structure against which they connect, in order to therefore transferring the pressure, when performing said pressing treatment, as effectively as possible, with a minimum of risk of deformation of the press parts 15 themselves. In the case that a heated press 3 is used, which, amongst others, is the case when pressing DPL, also a better contact with the underlying structure, either the base element 16, or the heating plate of the press, can be guaranteed by using a globally flat rear side 29, as a result of which an efficient heat transfer towards the press parts 16 and from the press plates 15 towards the product to be pressed can be ascertained.

According to the invention, the press elements 14 with the press parts 15 to be provided thereon can be performed such that the location of one or more press parts 15 in respect to the base element 16 and/or the mutual location of the press parts 15 can be chosen differently in function of the press treatment to be performed, either in that the respective press parts 15, when composing the press element 14, are attached at fixed locations in function of the intended press treatment, or in that the location of one or more press parts 15 in respect to the base element 16 and/or in respect to others of the press parts 15 is adjustable, more particularly can be regulated and therefore can be altered at all times in function of the intended press treatment.

The possibility for selecting the aforementioned locations is particularly advantageous when manufacturing floor panels 1 of the type, wherein the board-shaped elements 2 are provided with a decor layer 5 that consists of a printed and resin-treated material web, such as printed and resin-treated paper, which originates from a material web with a longitudinal direction and a transverse direction, wherein this material web also becomes pressed. When treating such material webs with resin, they are drawn through a resin-applying installation. As a consequence of the forces herein occurring in the material web and of the fact that the material is weakened under the influence of the moist resin, a certain stretching is created. Herein, in particular the stretching in width direction is difficult to control, at least in the case of paper. A consequence hereof is that the paper, and thus also the decor printed thereupon, extends over different widths in function of the one material web, or thus paper web, to the other, as a result of which it is excluded to perform, with one and the same large press plate, impressions which are in register with the printed decor over the entire width of the material web. By now using separate press parts 15, the advantage is obtained that the press parts 15 can be positioned on the base element 16, or a possible other supporting structure, at mutual locations, which are determined in function of the stretching of the material web, and preferably at least in function of the stretching in width.

Indeed, after impregnation of such material web the stretching in width can be measured in a simple manner. In view of the fact that this stretching mostly is rather constant for material sheets originating from the same material web, for example, the same roll of paper, then the press parts 15 can be adjusted in an optimum manner for press-treating the entire batch of material sheets originating from the respective material web.

An optimum adjustment then can consist in that the press parts 15 are positioned at such mutual locations, that the relief for forming the impressions per press part is as much as possible in register with the pattern of the printed decor. Herein, for example, each press part can be provided with its pressing side 20 at the press element 14 in such a manner that the relief in the center of each press part 15 is in register or approximately in register with the motif of the printed pattern situated therebelow during pressing. The possible deviations between the relief for forming the impressions and the printed decor, which then still may occur at the height of each press part, then are very limited as such.

Such adjustment is particularly beneficial in width direction, however, it is not excluded to also realize it in longitudinal direction, whether or not in combination with the adjustment in width direction.

According to a particular form of embodiment, the method of the invention is characterized in that the positioning is performed in function of the stretching in transverse direction as well as in longitudinal direction; that, for the press element, use is made of at least two base elements situated in longitudinal direction one after the other, which each possess a number of press parts situated in transverse direction adjacent to each other; and that said positioning in longitudinal direction is at least realized by displacing the base elements with the press parts present thereon more or less away from each other, whereas the positioning in transverse direction is realized by displacing the press parts as such more or less away from each other.

Figure 7:
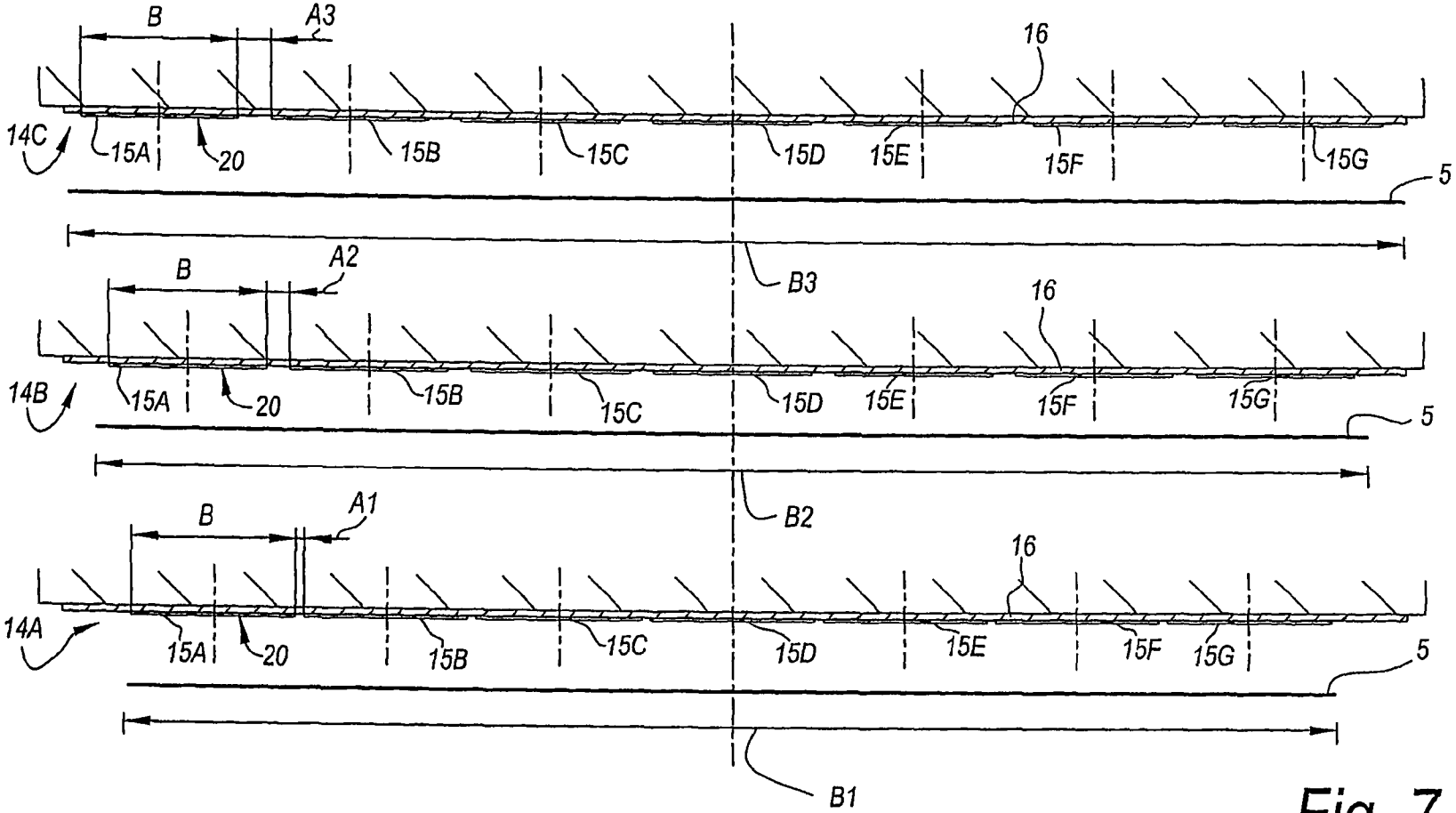
FIG. 7 schematically represents a series of press elements according to the invention.

According to a particular form of embodiment of the method of the invention, a series of two or more press elements is used, which have identical press parts that are provided on respective base elements in uniform configurations, wherein the press parts—or at least the relief patterns present thereon—are situated, at least in the aforementioned transverse direction, at different distances from each other for the different press elements, such that press elements are obtained, each being suited for press-treating similar material sheets, which, however, are stretched differently, wherein for pressing then, in function of the stretching, the most suitable press element of said series is selected. For clarity's sake, an example thereof, wherein a series of three press elements 14A-14B-14C is employed, is schematically represented in FIG. 7. Each of the three press elements, 14A, 14B and 14C, respectively, comprises an identical series of press parts 15A through 15G. This means that the press parts 15A of the respective press elements 14A, 14B and 14C are provided with an identical relief. The same applies to all press parts 15B and so on. As schematically illustrated in FIG. 7, the press parts 15A to 15G are provided per press element, 14A, 14B and 14C, respectively, at this press element 14 at other mutual distances A1, A2 and A3. If now material layers 5, more particularly material sheets, with a width B1 are utilized, in which a minor stretching has occurred during the resin treatment, then use can be made of the press element 14A. For a somewhat larger stretching, for example, in a material sheet with the represented width B2, then one may resort to the use of press element 14B. For a still larger stretching, for example, in a material sheet with the represented width B3, finally the press element 14C can be selected.

It is noted that this stretching in FIG. 7 is depicted relatively large. In reality, this relates to a stretching in the order of magnitude of only several millimeters, for example, 2 to 3 millimeters over a width of, for example, two meters.

It is clear that this technique offers the advantage that no three large press plates must be produced, all three with a differently stretched relief for forming the impressions, but that according to the invention now small press parts 15A to 15G can be used, which are identical per press element 14A-14B-14C, but only have to be attached thereto at different mutual distances A1-A2-A3. The deviations occurring within the width B of each press part between the relief and the decor are negligible as such.

Figure 8:
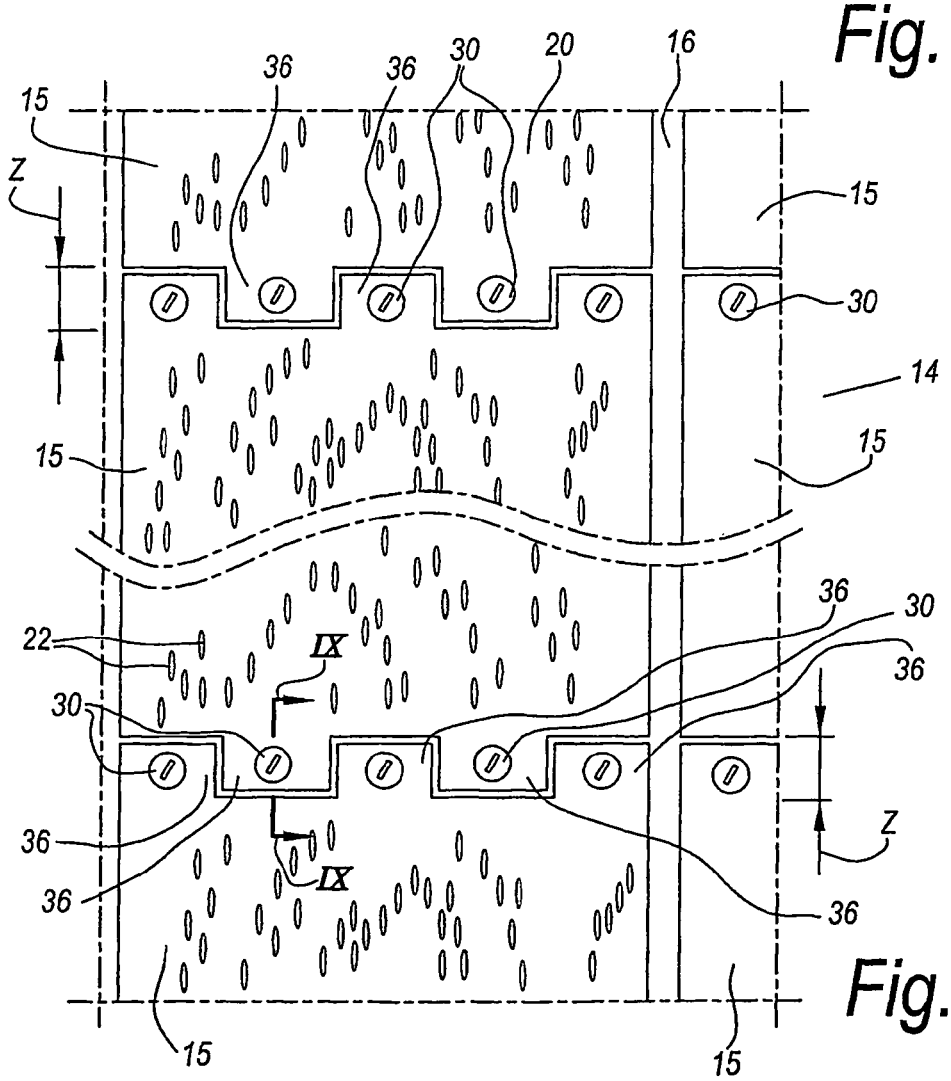
FIG. 8 represents a detail of a form of embodiment of a press element according to the invention.
Figure 9:
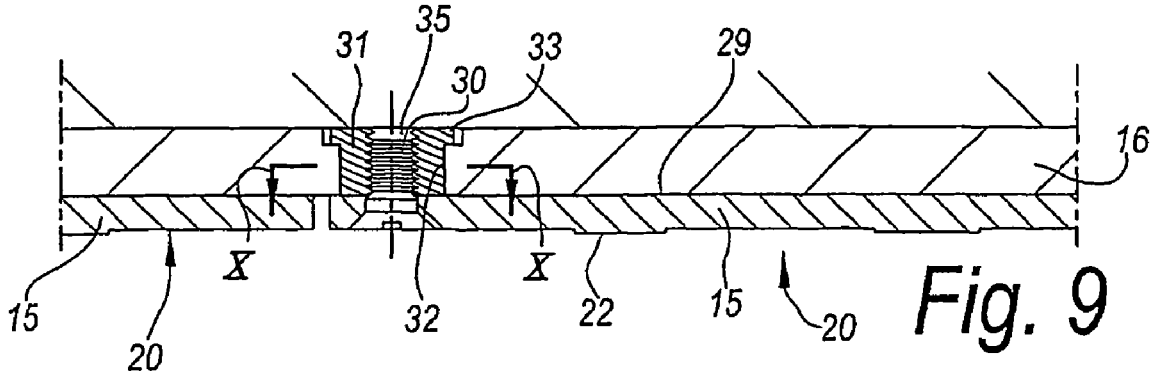
FIG. 9, at a larger scale, represents a cross-section according to line IX-IX in FIG. 8.
Figure 10:
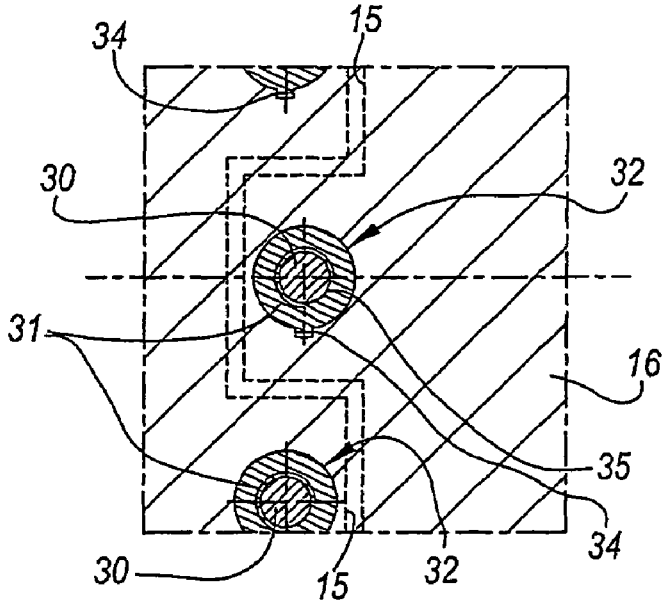
FIGS. 10 and 11 represent cross-sections according to line X-X in FIG. 9, in two different positions.
Figure 11:
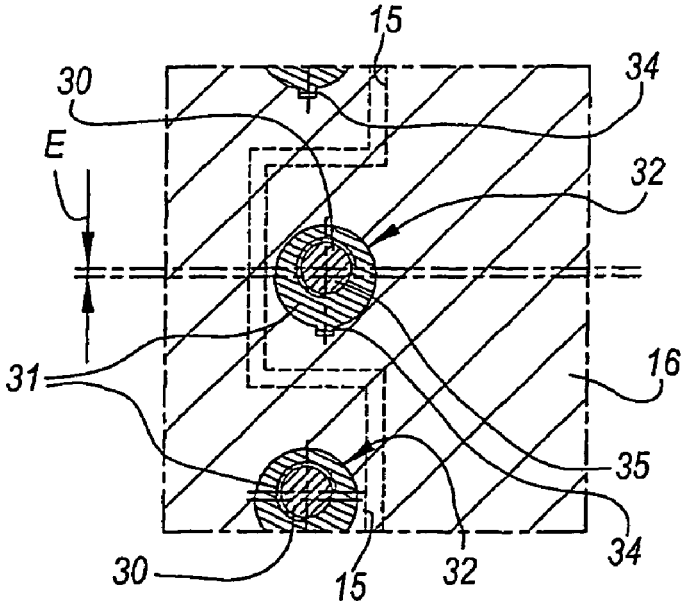

In FIGS. 8 to 11, a practical form of embodiment is represented for applying the separate press plates 15 at a base element 16 in such a manner that their position is adjustable. Herein, the press parts 15 are attached to the base element 16 by means of screws 30. These screws 30 engage in elements 31, more particularly small bushes, which are provided in seats 32, more particularly bores, in the base element 16. The elements 31 are retained in axial direction by means of a collar 33, whereas they are locked against rotation by means of a projection 34 fitting into a corresponding recess in the base element 16. In order to allow for an adjustment of the press parts 15, different series of elements 31 are available, the elements of which are differing in mutual respect in that they have screw bores 35 for the aforementioned screws 30 provided at different eccentric distances in the elements, in such a manner that, by the choice of the applied elements, a shifting in the location of the press plates 15 at the base element 16 can be performed. This latter is shown in FIGS. 10 and 11, wherein FIG. 11 represents the attachment of a same press part 15 as that of FIG. 10, however, with another element 31. In FIG. 10, eccentricity is zero, whereas in FIG. 11, it is not zero and is indicated by E. This distance E also forms the difference in localization of the press part.

As represented in FIG. 8, the press parts 15 may be performed such that they fit into each other with finger-shaped ends 36 or the like at the edges, wherein at the height of these finger-shaped ends 36 then the above-described attachment parts, more particularly the elements 31, are provided. This has the advantage that the zone Z, within which the attachment parts are present, can be kept small and possibly can be limited to the zones where the aforementioned saw cuts are performed and the coupling means are realized in. In these zones, namely, the top layer is removed and thus it is no disadvantage that possible imprints of the screws 30, that might occur during the press treatment, are formed in the top layer.

It is clear that the above-described attachment parts solely form an illustrative example and that it is not excluded to realize such adjustable attachment parts in any other manner. Possibly, such attachment parts can be provided with adjustment means, such that, when altering the position of one of the press parts 15, automatically and in accordance also the positions of the other press parts 15 are altered. According to a further possibility, the adjustment means also may be automated, wherein the positioning of the press plates 14 then is performed automatically, in function of, for example, input values that are representative for the aforementioned stretching.

Generally, it is preferable that one or more of the press parts 15 are corresponding to the floor panels 1 to be formed, by which is meant that the surface of one press part has such dimensions and is localized such that hereby, the surface of exactly one floor panel 1 or exactly a multiple of floor panels 1 can be pressed.

It is clear that the distance between the useful surfaces of the press parts 15 preferably is not larger than the minimum intermediate distance necessary for forming the aforementioned saw cut and the aforementioned coupling means.

According to a particular characteristic of the invention, the press parts 15 are produced at the floor panel manufacturer's himself. In that only relatively small press parts 15 have to be formed, such technique can be more easily established on site then this is the case up to now when producing large press plates.

According to another particular form of embodiment, the press plates 15 will be manufactured from plate, more particularly steel plate, originating from a roll, more particularly originating from strip steel. An advantage thereof is that such strip steel is universally available on the market, contrary to large press plates that specifically have to be produced for press treatments.

It is noted that the method according to the invention is not restricted to press treatments for manufacturing DPL, but may also be used with other methods for manufacturing floor panels 1, wherein a press treatment is applied. So, for example, it may also be applied when pressing so-called HPL (High Pressure Laminate). It may also be used in combination with techniques, wherein a decor is printed directly on the substrate and thereafter impressions are pressed into the surface by means of a press treatment.

Figure 12:
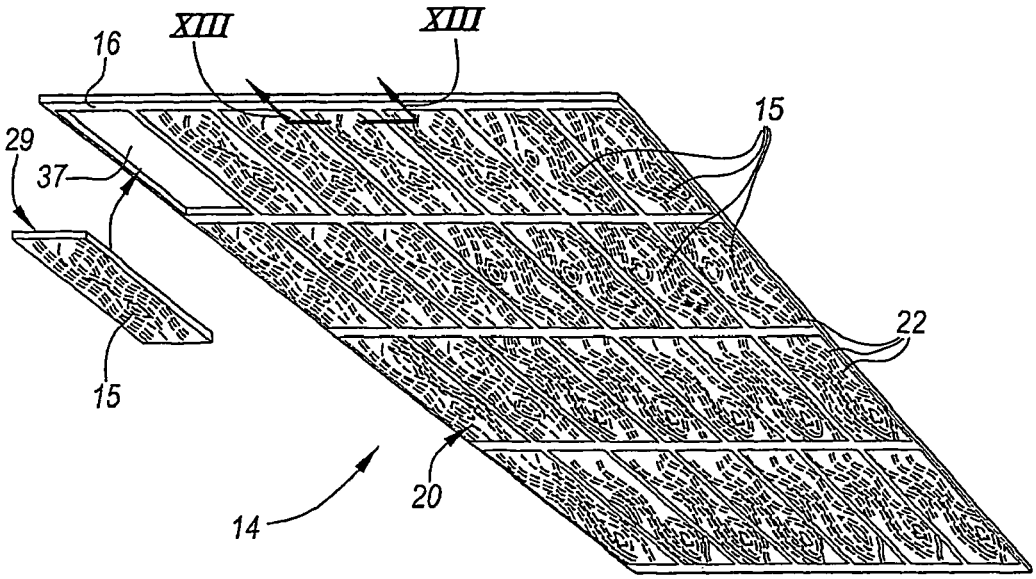
FIG. 12 represents another variation of a press element of the invention.
Figure 13:
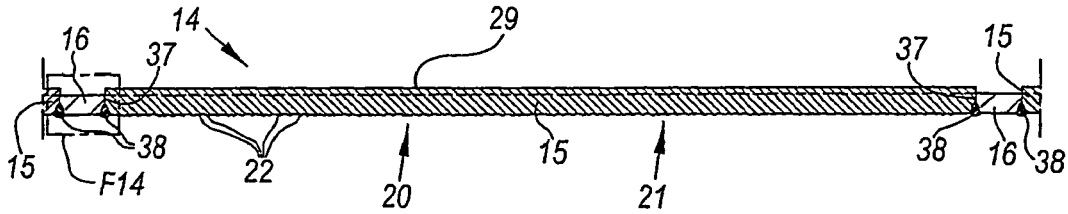
FIG. 13, at a larger scale, represents a cross-section according to line XIII-XIII in FIG. 12.

Also, it is noted that the aforementioned common base element 16 must not necessarily be implemented as a plate. As schematically represented in FIGS. 12 and 13, this may also consist of a frame-shaped structure, in which through openings 37 are provided in which the press parts 15 can be fixed, which then preferably are made thicker than the thickness of the frame-shaped structure itself. An advantage thereof is that the separate press parts 15 then directly can contact the heated press part with their rear side in order to guarantee a good heat transfer.

Figure 14:
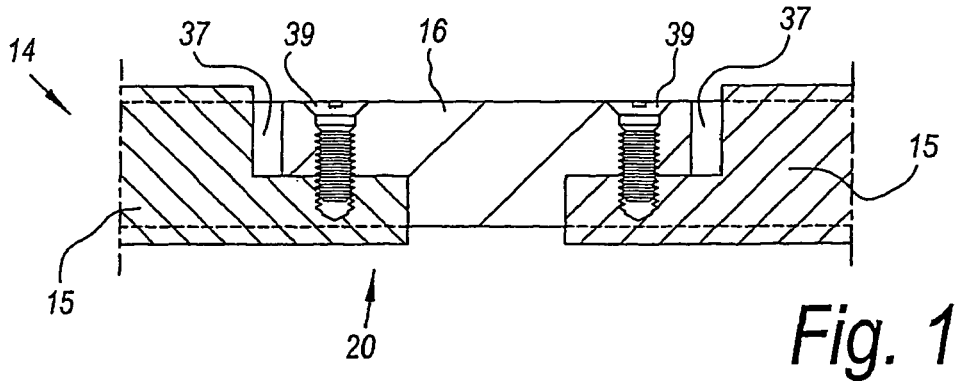
FIG. 14, at a larger scale, represents a view of the portion indicated by F14 in FIG. 13, however, for a variation.

The attachment of the press parts 15 in the frame-shaped structure can take place in any manner. In FIG. 13, this is realized by means of welding connections 38. Possibly, such welding connections may be performed very finely by making use of welding performed by means of a laser. FIG. 14 shows a variation in which the attachment takes place by means of screws 39.

According to another variation, the press parts 15 may also be applied without a base element 16, for example, when use is made of an adapted press 3, in which the press parts 15 can be attached separately, or, for example, when use is made of press parts 15 which, whether or not by means of additional coupling pieces, mutually can be attached next to and to each other, such that they practically form a whole.

In FIGS. 15 to 23, a number of examples are represented, wherein such press element 14 substantially is constructed exclusively of separately formed press parts 15, thus, without the use of a base element 16.

Figure 15:
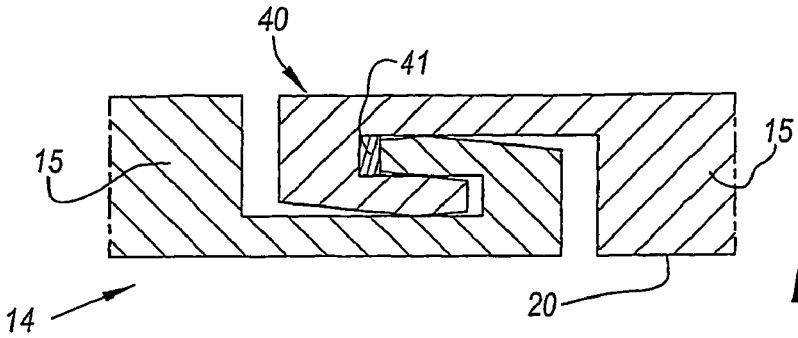
FIGS. 15 to 19 in cross-section represent different possibilities for mutually coupling separately formed press parts.
Figure 16:
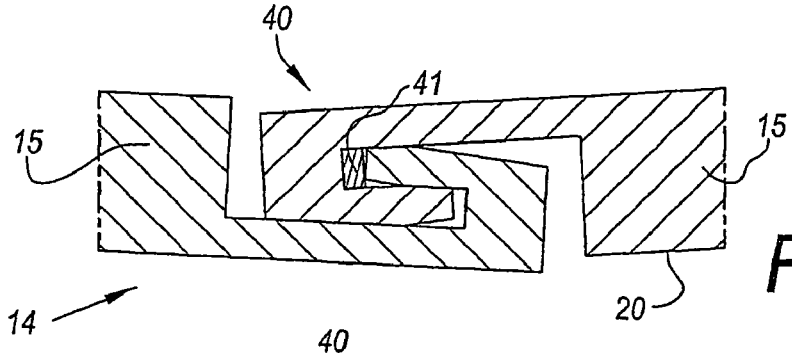

In the embodiment of FIG. 15, the press parts 15 are directly coupled to each other at their edges by means of coupling means 40 in the form of hook-shaped edge portions that engage one behind the other. FIG. 16 shows that these edge portions can be made such that they allow for a certain mobility, as a consequence of which the press element 14 formed by the press parts 15, when the press opens, can sag under its own weight, without subjecting the edge portions to torsion forces in this. As illustrated in FIGS. 15 and 16, intermediate parts 41 can be provided between the edge portions, said parts determining the mutual distance between the press parts 15, such that, by an appropriate choice of these intermediate parts 41, the mutual position between the press parts 15 can be altered and, for example, in this manner an adjustment can be provided in function of the decor of the decor layer to be pressed, more particularly in function of the stretching that has occurred in this decor layer during the resin-treatment.

Figure 17:
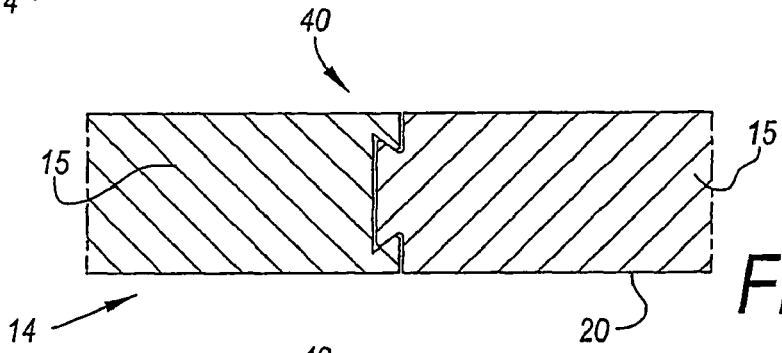
Figure 18:
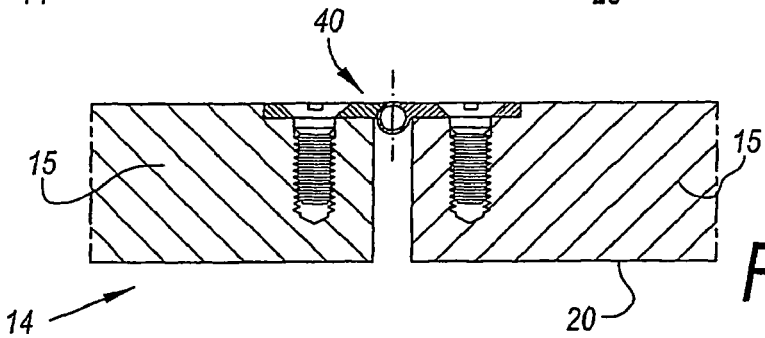
Figure 19:
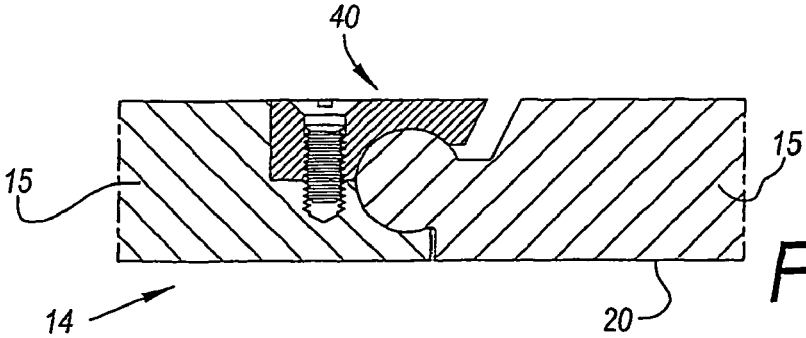

FIG. 17 shows a variant wherein the coupling means 40 are formed by a dovetail connection. FIGS. 18 and 19 represent two forms of embodiment, wherein the coupling means 40 are formed by a hinge.

Figure 20:
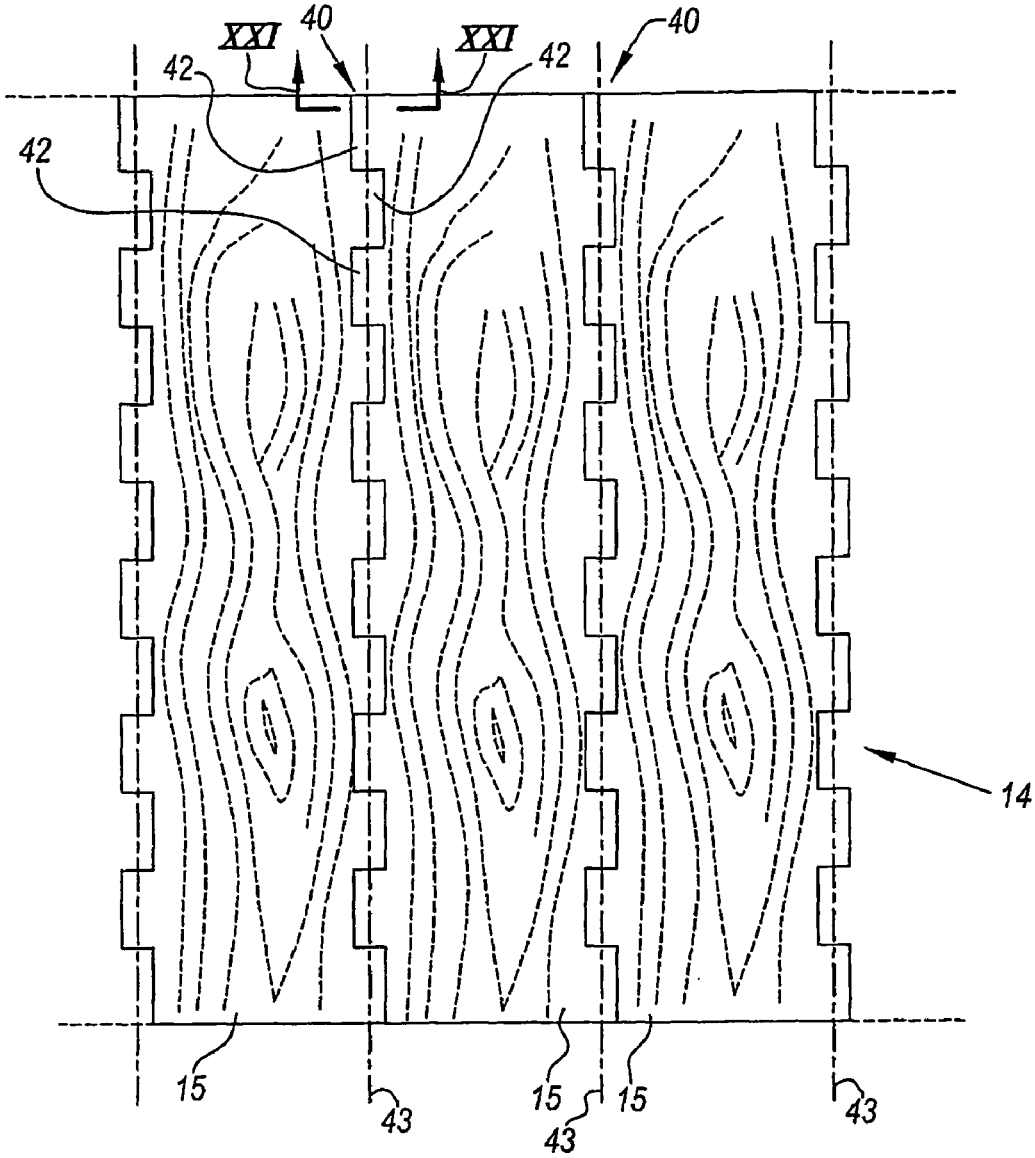
FIG. 20, in a front view, schematically represents another form of embodiment, in which separately formed press plates are mutually coupled.
Figure 21:
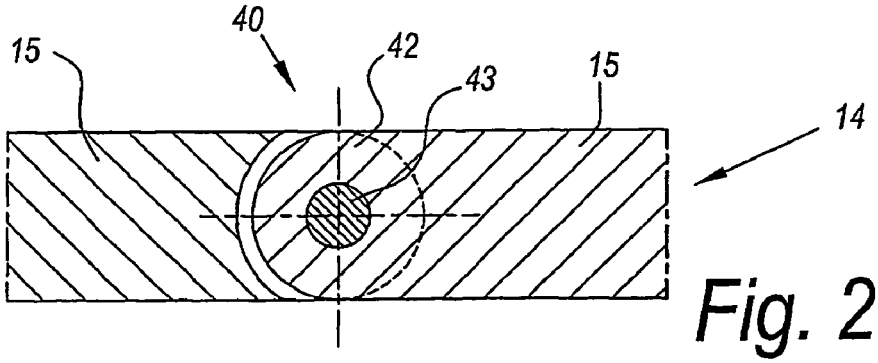
FIG. 21, at a larger scale, represents a cross-section according to line XXI-XXI in FIG. 20.

FIGS. 20 and 21 represent a form of embodiment wherein the plate-shaped press parts 15 fit into each other with finger-shaped edge areas 42 and are coupled in a hinged manner by means of rods or cables 43 extending transversely through these edge areas 42.

Figure 22:
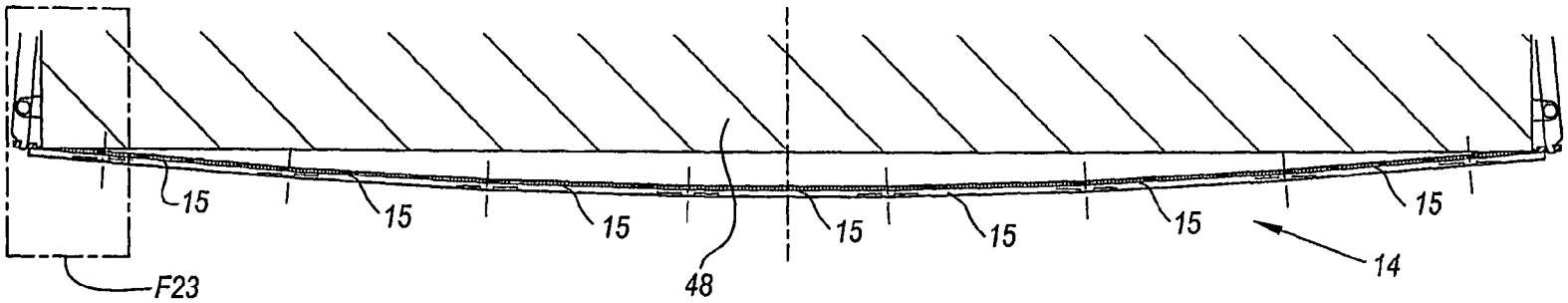
FIG. 22 schematically represents how mutually coupled press parts can be secured in a press.
Figure 23:
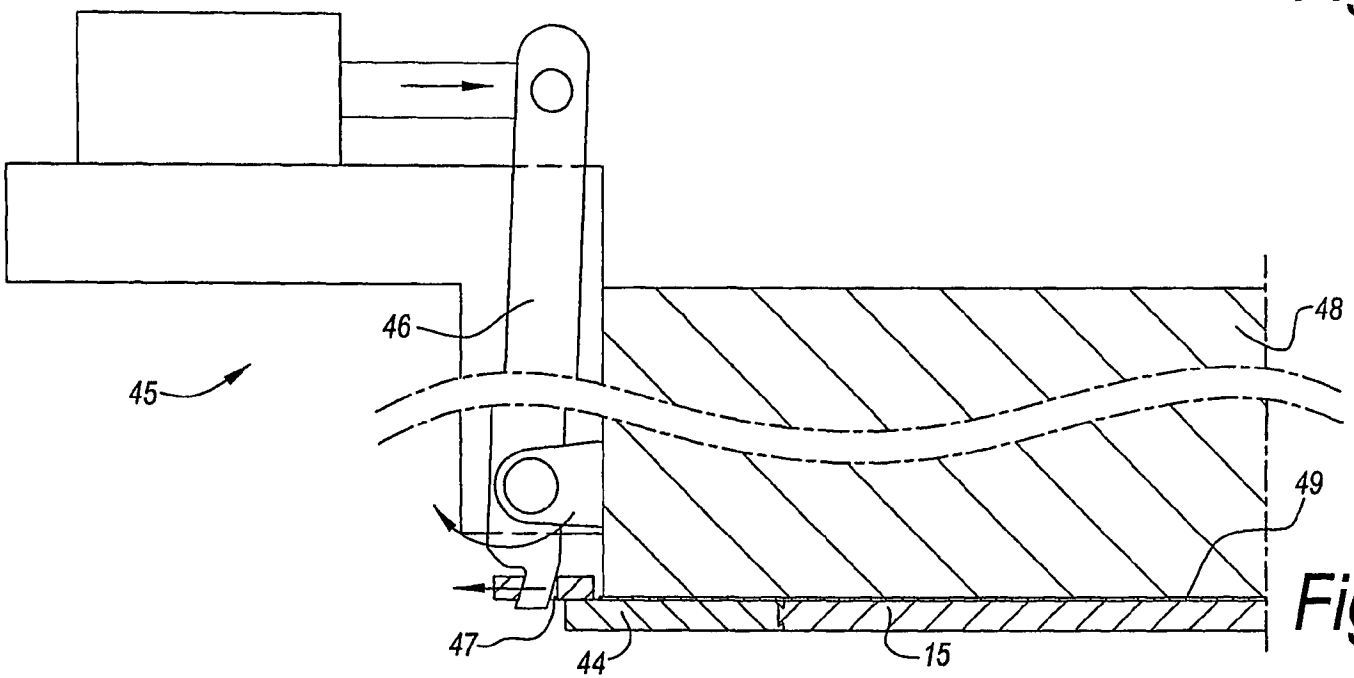
FIG. 23, at a larger scale, represents the portion indicated by F23 in FIG. 22.

FIGS. 22 and 23 represent a possibility for attaching such mutually coupled press parts 15 in a press. Herein, the press parts 15 situated at the exterior side are coupled to a connecting piece 44, which can work in conjunction with a clamping system 45 that is also applied for attaching traditional press plates. This clamping system 45 comprises a lever 46 that engages in an opening 47 in the connecting piece 44. By means of the clamping system 45, the whole formed by the press parts 15 is retained against the mostly heated press part 48. As can be seen in FIG. 22, herein it is not excluded that the press element 14 in its entirety is sagging somewhat in the opened condition of the press 3.

In order to ascertain a good heat transfer, heat conducting pastes or the like can be applied. So, for example, may such heat conducting paste be applied between the press parts 15 and the base element 16, which are represented in FIGS. 8 and 9. Also, it is possible to provide, for example, heat conducting mats or the like between the press parts 15 and the base element 16.

Also, in a traditional manner a heat conducting mat or the like may be provided between the base element 16 and the adjacent press part. In the case of an embodiment without base element 16, it is clear that such heat conducting mat 49 can be provided directly between the press parts 15 and the respective press part 48, as schematically represented in FIGS. 22 and 23.

The heat transfer may also be enhanced by incorporating in the material of the press parts 15, which mostly consists of steel, a certain copper content or by vapor metallizing copper, or by using, instead of steel, exclusively good heat conducting materials, such as, amongst others, copper.

In certain applications, it can be useful to provide for that the press parts 15 are at least partially freely movable in respect to the base element 16, in order to prevent a deformation of the press parts 15 when, under the influence of temperature, different expansions would occur in the base element 16 and the press parts 15. In the embodiment of FIGS. 8 to 11, this might, for example, be realized by fixedly attaching the press parts 15 next to one extremity by means of the aforementioned screws, whereas they are held freely movable in the plane of the base element 16 at the other extremities.

For clarity's sake, it is noted that by "separately formed" press elements is meant that these have been separate elements before and/or during the application at the base element and/or the application thereof in the press. Preferably, these press elements in fact first are formed out of a base plate and only afterwards are provided with the possible relief, however, it is not excluded to first provide a larger plate with a relief and then divide it into smaller portions, which then form the aforementioned press parts.

According to the method of the invention, preferably press parts are used that are considerably smaller than the traditional press plates. Preferably, press parts are used, the pressing side of which has a surface of less than 3 square meters, and still better of less than 1.5 square meters, and even better of less than 0.5 square meters. Also, it is preferred that press parts are used, the pressing side of which has a surface corresponding to maximum eight and preferably maximum five floor panels to be manufactured. In a practical form of embodiment, press parts are used, the pressing side of which covers a surface with which the surface of precisely one floor panel can be formed. Also, it is not excluded to use press parts with a surface that is smaller than that of a floor panel to be realized.

According to a particular possibility, press parts are applied in the form of elongated strips, which are intended, for example, for forming a surface that corresponds to a plurality of floor panels situated longitudinally one after the other.

The number of press parts applied in the same press preferably is 6 to 50, and more specifically 8 to 30, which preferably all are provided on the same base element, or possibly on two base elements, or, whether directly coupled to each other or not, are directly mounted in the press.

According to a particularly preferred form of embodiment, three press parts 15 are provided in the width of the press element 14. Hereby, a good compromise is obtained between the number of press parts 15 that have to be realized separately, and the adjustability in order to counterbalance stretching in the decor layer to a sufficient extent. Herein, it is, for example, possible to maintain the central press part 15 in a fixed position, whereas the outermost press parts 15 situated at opposite sides thereof are laterally adjustable.

Further, it is preferable that in the longitudinal direction of the press element 14 respectively two press parts 15 are provided one after the other, wherein the mutual position in longitudinal direction of these press parts preferably is adjustable, too.

Figure 24:
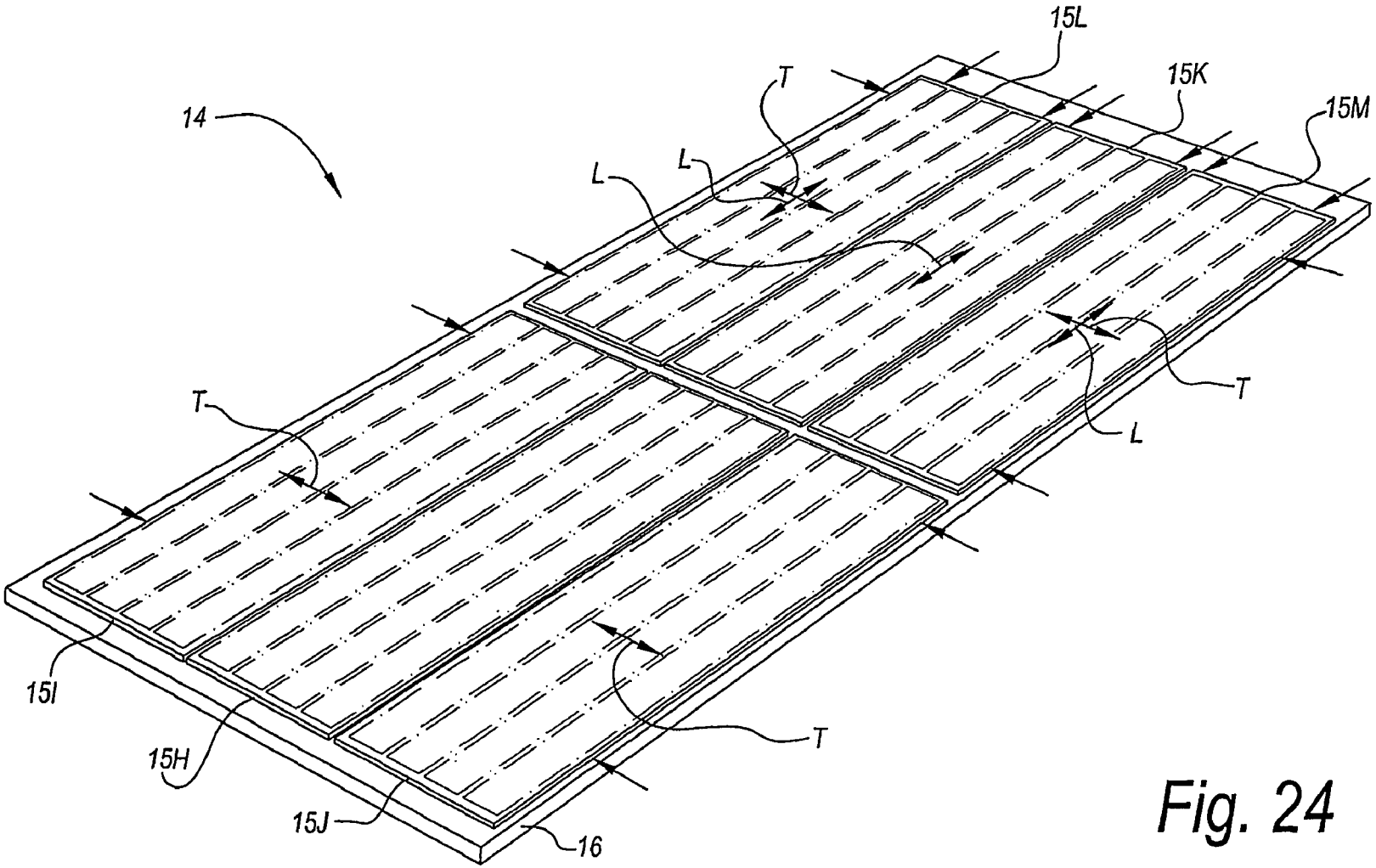
FIGS. 24 and 25 schematically represent two embodiments of a press element according to the invention.

In FIG. 24, schematically a practical example of a press element 14 is illustrated, with one common base element 16, upon which, as noted above, six separately formed press parts 15 are present, which, in order to distinguish them, are indicated by reference numbers 15H to 15M. In the example, the press part 15H is fixedly attached to the base element 16, whereas the press parts 15I and 15J are displaceable in transverse direction T. The press part 15K is exclusively displaceable in longitudinal direction L, whereas the press parts 15L and 15M are displaceable in longitudinal direction L as well as in transverse direction T. It is clear that, when pressing a board-shaped element 2, this latter, with the decor layer present thereon, will be positioned under the press such that the decor portion thereof, which must correspond to the press part 15H, is situated precisely underneath this press part 15H. By now providing a priori for that the positions of the press parts 15I to 15M, in respect to the press part 15H, are adapted in function of the stretching that has occurred in the decor layer, then it will be automatically obtained during pressing that all press parts 15H to 15M are situated in an optimized manner opposite to the corresponding decor portions of the decor layer, as a consequence of which then even with a "registered embossed" panel very narrow tolerance limits between the position of the impressions and the position of the pattern represented by the print of the decor layer can be guaranteed.

The sectioning that is applied in FIG. 24 is particularly suited for press elements 14, the outside dimensions of which correspond to the dimensions of the press plates traditionally used for manufacturing floor panels. The overall length of the whole from FIG. 24 then preferably is in the order of magnitude of 5 to 6 meters, for example, 5.6 meters, whereas the overall width preferably is in the order of magnitude of 2 to 3 meters.

Figure 25:
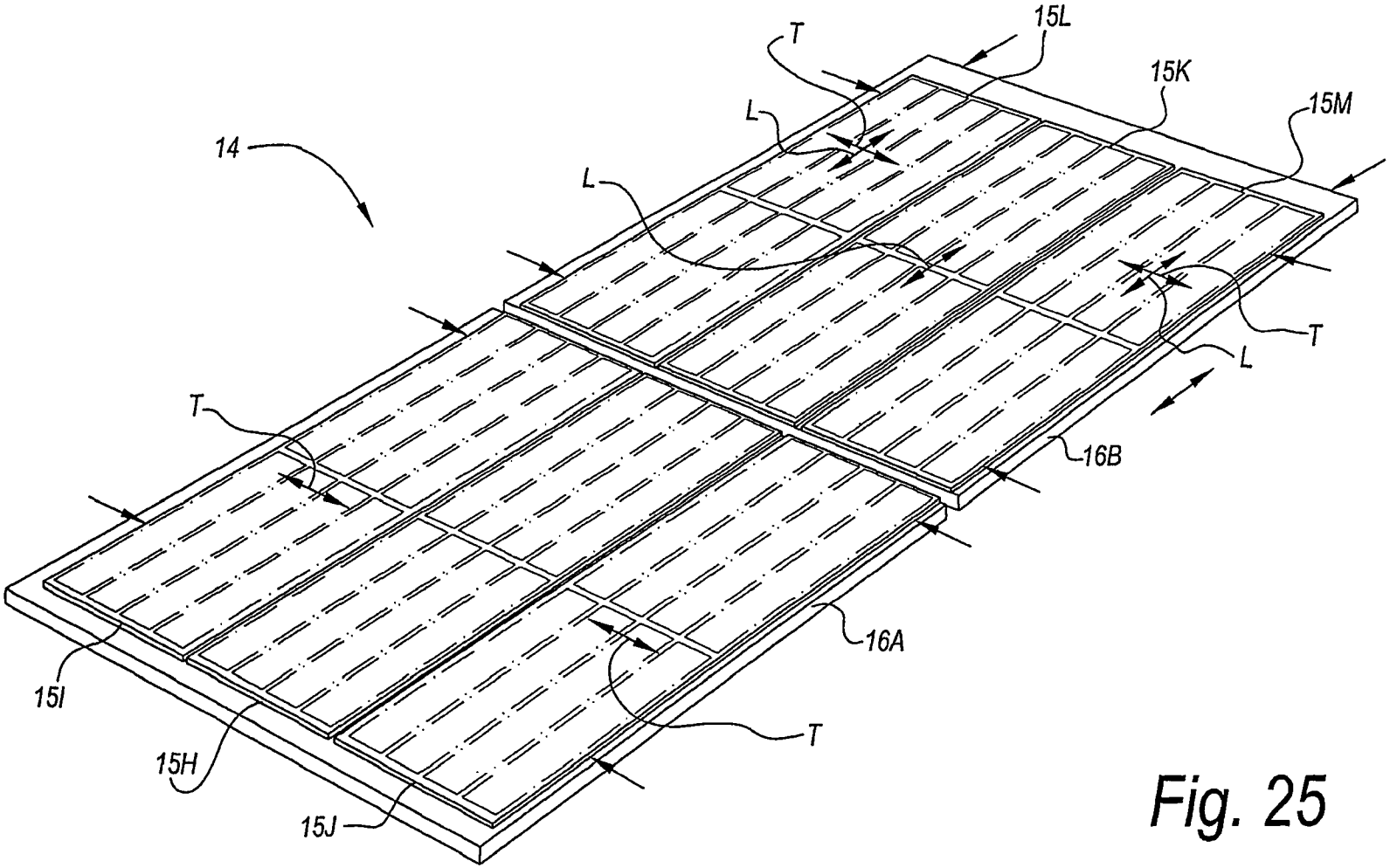

FIG. 25 represents a variant with a sectioning of the press parts 15 as in FIG. 24, however, wherein two base elements 16A-16B are used, which each comprise three press parts, 15H-15I-15J and 15K-15L-15M, respectively. In such case, the adjustment in the longitudinal direction L possibly may take place by means of the mutual displacement of the base elements 16A and 16B in longitudinal direction.

Figure 26:
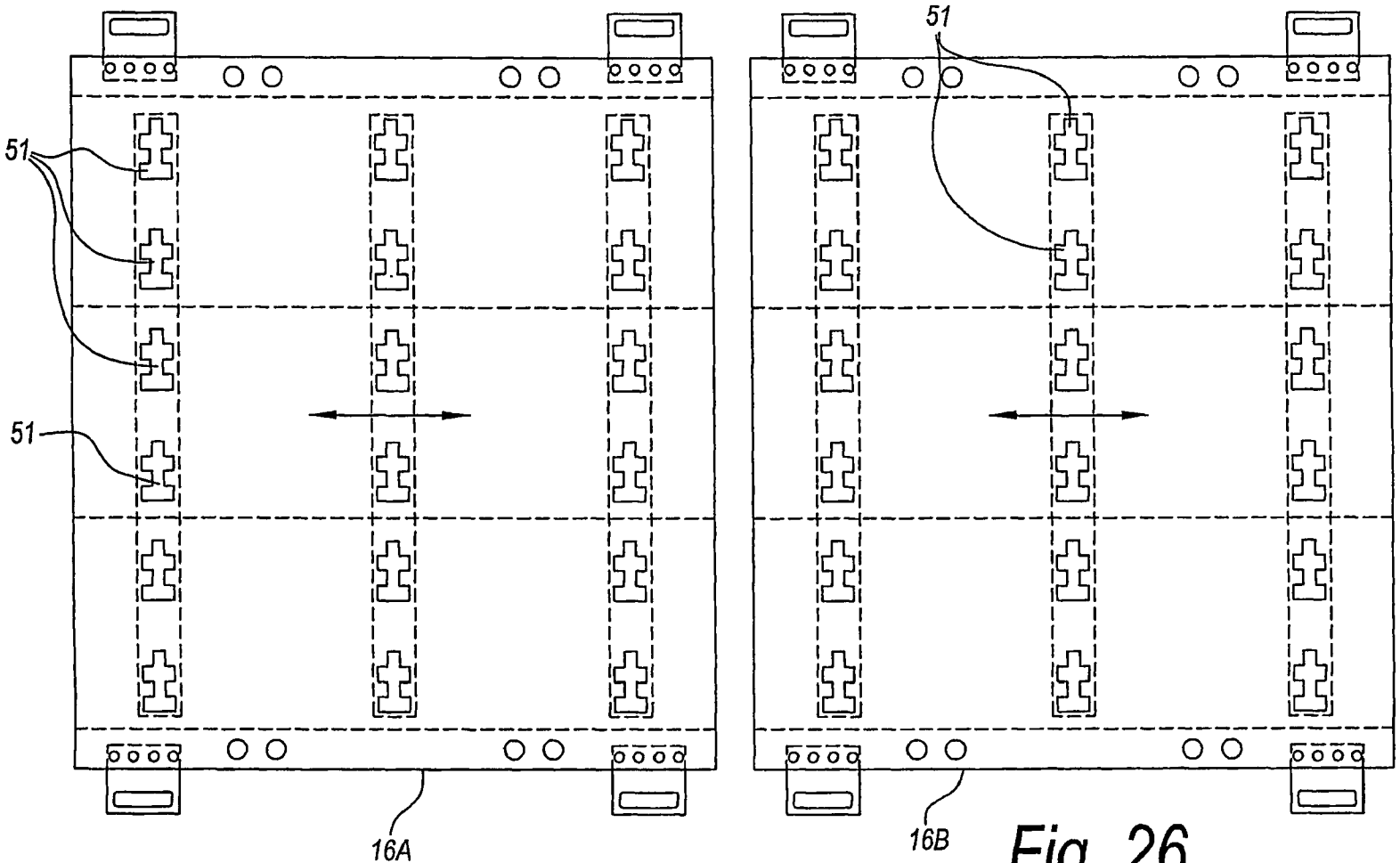
FIG. 26 represents a bottom view of the base elements used in the press element of FIG. 25.
Figure 27:
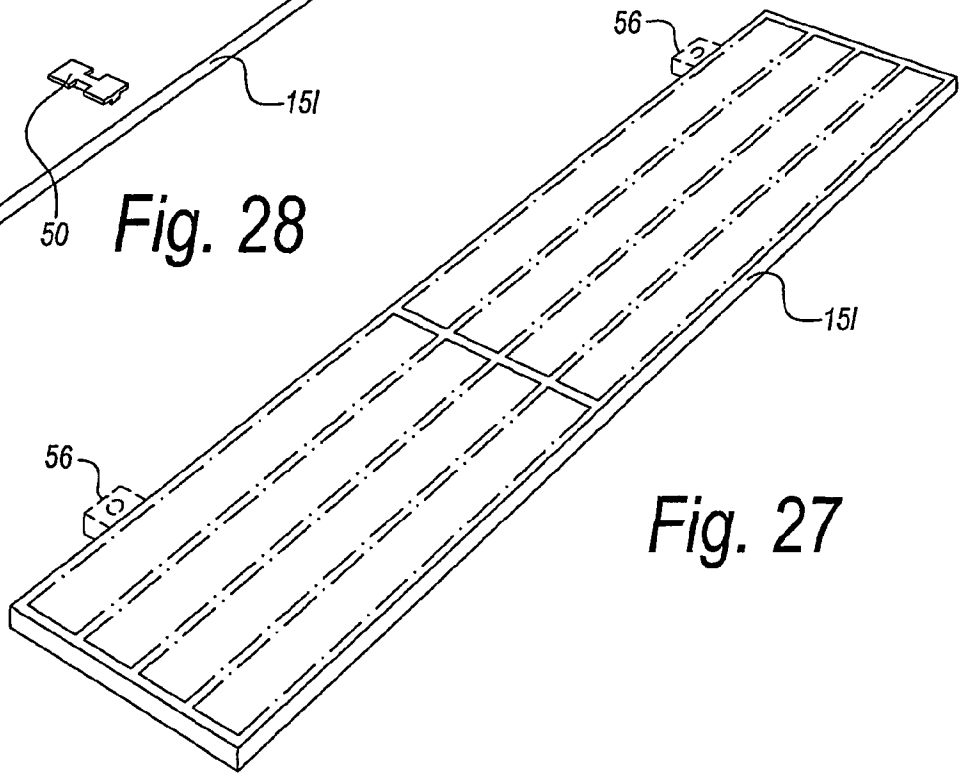
FIGS. 27 and 28, in bottom view, top view, respectively, represent a press part of the press element of FIG. 25.
Figure 28:
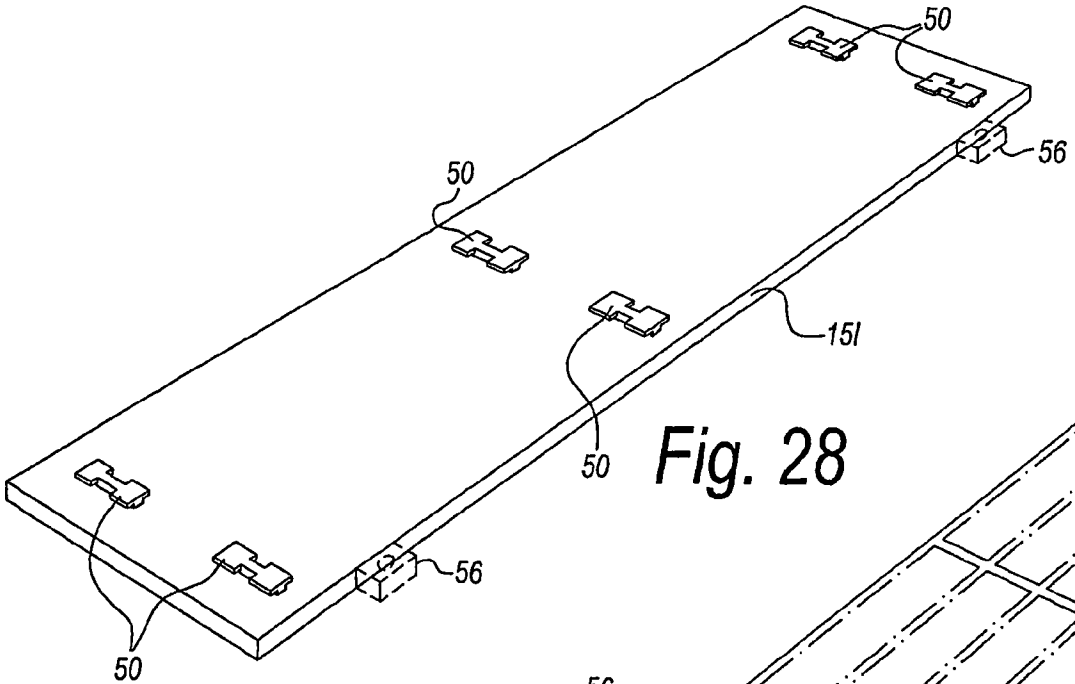
Figure 29:
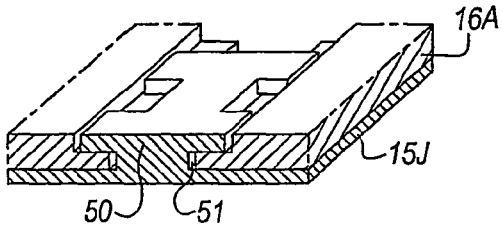
FIG. 29 in cross-section represents how in the form of embodiment of FIG. 25 a press part is coupled to a base element.

FIG. 26 represents a possible form of embodiment of the base elements 16A-16B, whereas FIGS. 27 and 28 represent the bottom side and top side, respectively, of an associated press part 15, in this case, 15I. The press parts are provided with suspension parts 50, in this case, T-shaped projections, which can cooperate with recesses 51 in the base elements 16A-16B, and which, in the coupled condition, allow a displacement of each respective press part in respect to the associated base element in transverse direction. The cooperation is illustrated in FIG. 29. The displacement and adjustment may either take place manually, whether or not by the intermediary of a drive element, whether or not motor-driven, or automatically. It is clear that herein, the necessary arrangements will be taken such that, after the desired adjustment has been performed, no further displacement will occur. These arrangements may consist in that not-represented additional locking elements are provided, which, after the adjustment of the position of the press parts 15, allow to lock each respective press part in respect to the respective base plate 16A-16B, or that use is made of drive elements that, in resting position, keep their last-set position.

Figure 30:
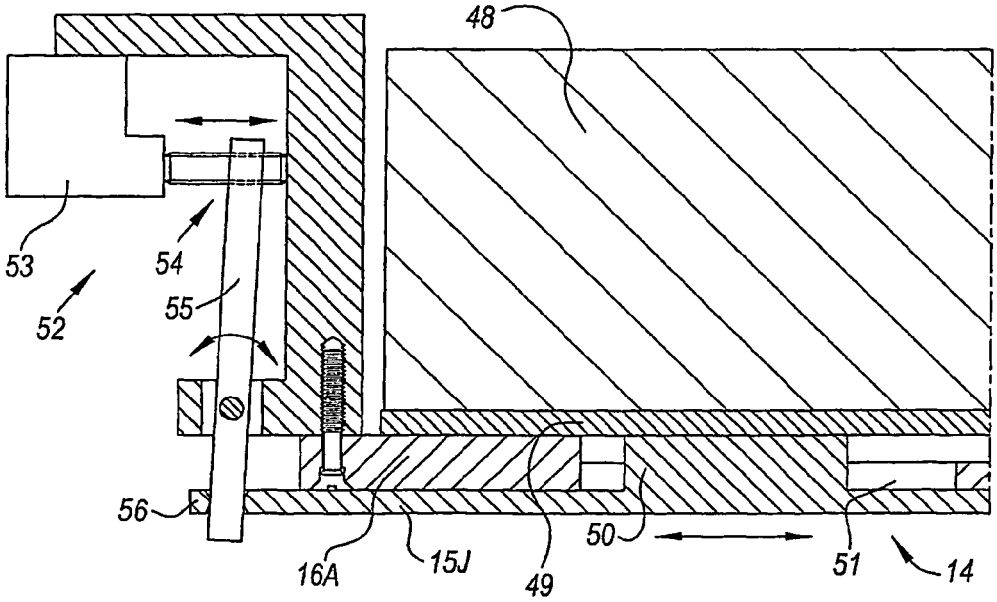
FIG. 30 represents how the position of a press part that is already provided in a press can be controlled.

FIG. 30 represents an embodiment of such drive element, consisting of an actuator 52. This actuator 52 is formed by a motor 53, which, by means of a transmission 54, can move a lever 55, which engages in a portion 56 associated with the press part 14J. By changing the position of the lever 55 by means of the motor 53, the position of the press part 15J can be adjusted.

From the above, it is clear that in general the adjustability and/or possibility of regulating can be implemented in different manners. The most important three possibilities are the following:

an adjustment per batch of decor layers to be pressed, wherein the positions of the press parts 15 are adjusted beforehand in function of the decor, more particularly taking into account the stretching that globally has occurred during the manufacture of this batch of decor layers;

an adjustment per batch of decor layers, wherein working is performed with several press elements 14, with differently positioned press parts 15, wherein, taking into account the stretching that globally has occurred in the batch to be pressed, for this batch a choice from the different press elements is made;

an adjustment, wherein the mutual positions of the press parts 15 are controlled in function of alterations occurring in the decor as a result of more or less stretching.

With the first two possibilities, it is not excluded to perform, during the pressing of a batch of decor layers, an intermediate stop and indeed alter the positions of the press parts in the case that in one batch of decor layers too large a variation does occur. With the aforementioned third possibility, the control may be performed, for example, automatically in function of measurement and detection values, performed on the decor layer. Herein, the control may take place continuously, by which is meant that it is determined per decor layer whether an adjustment is necessary and, if yes, this latter also will be performed, or may take place discontinuously, by which is meant that such control and/or adjustment is performed, for example, with intervals and thus not per decor layer.

Figure 31:
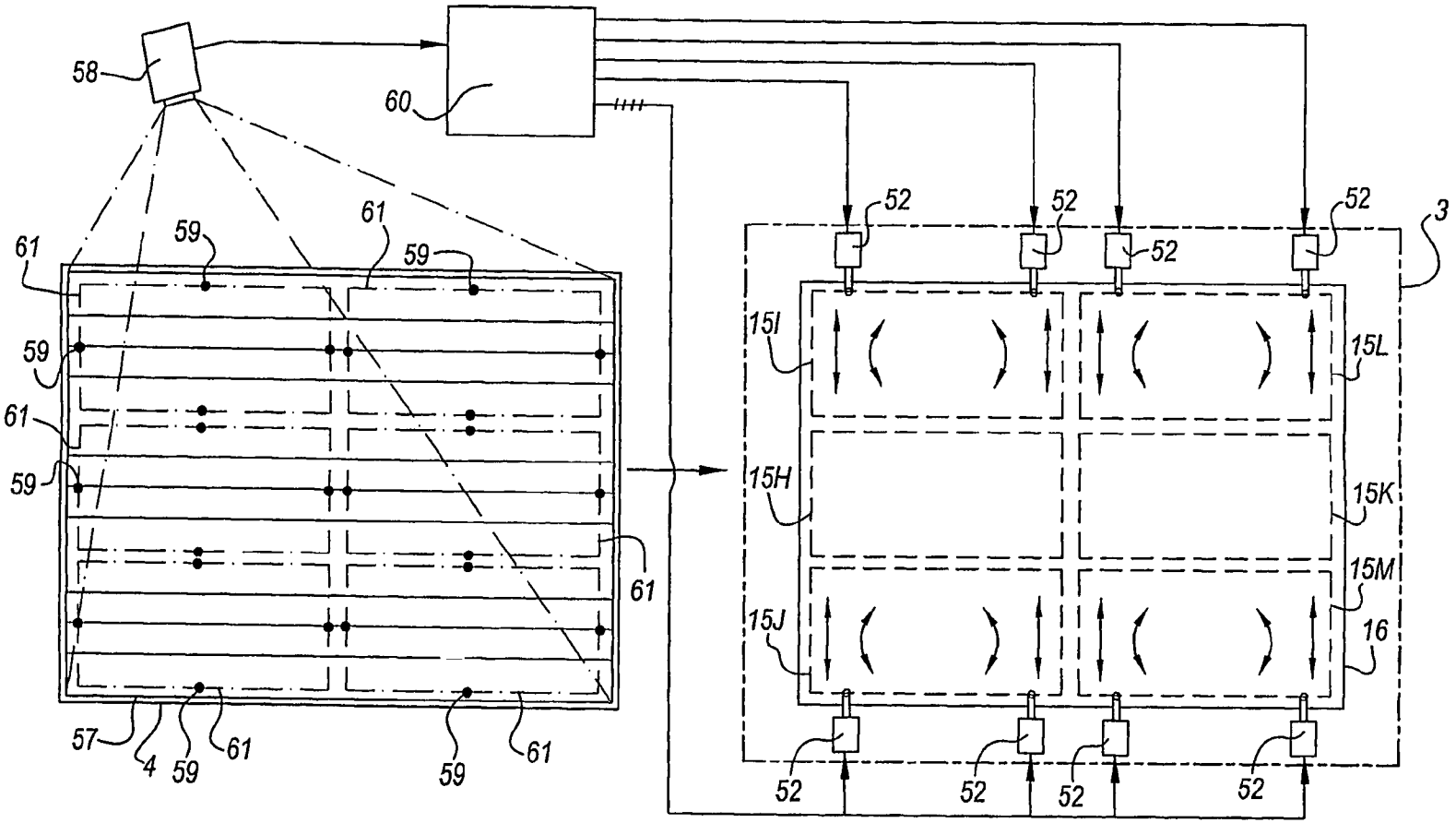
FIG. 31, in a top view and highly schematized, represents a form of embodiment of a press, wherein the position of the press parts is automatically controlled.

FIG. 31 represents an arrangement, by which an adjustment according to the third possibility can be realized. The decor layer 57, which is already situated on the substrate 4, is scanned before being driven into the press 3, in this case by means of a camera 58 that recognizes the decor and/or observes marks 59 in the decor. From these data, the mutual positions of the decor portions 61, which latter must be positioned under the respective press parts 15, are precisely determined by means of a control unit 60. Subsequently, the press parts 15I-J and 15L-15M are displaced by means of the actuators 52 until the mutual position of the press parts 15H to 15M corresponds as good as possible with the detected mutual positions of the respective decor portions 60. By subsequently driving the substrate 4 with the decor layer 57 and possible other layers into the press and closing the press, a press pattern is obtained that takes the stretching and deformation of the decor layer into account. In the form of embodiment of FIG. 1 solely an adjustment in width is taken into account, however, it is clear that an adjustment in length can be performed in a comparable manner.

According to a variation, the detection of the position of the decor portions 60 might also take place when the decor layer is already in the press.

It is clear that the press parts 15, 15H-15M, respectively, possibly can also be subjected to a slight rotation, for example, in order to compensate a trapezium-shaped deformation in the decor.

Figure 32:
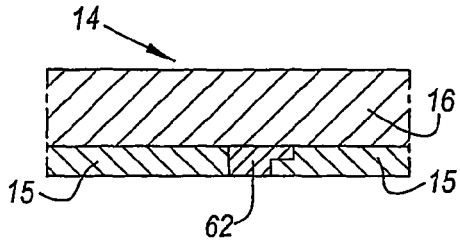
FIG. 32 in cross-section represents another detail of a press element according to the invention.

In that the press parts 15 are mutually adjustable, these are situated with their edges at small distances from each other. The gaps present therebetween may lead during pressing to an undesired build-up of resin, as no pressure is built on these locations and/or resin remains stuck at the edges of the press parts 15. As such, for example, a porous amount of resin that may crumble away can be created there, which contains corundum from the overlay, which amount, when it crumbles away, may end up between the floor panels finally to be formed and may cause scratches. Preferably, thus arrangements are made in order to remedy this. So, for example, one or more of the following arrangements can be made:

a filling means can be provided in the gaps in order to prevent, during pressing, that the resin can rise up between the press parts 15; herein, use can be made of any kind of suitable filling agent; thus, for example:

a rigid filling means, such as an insertion strip corresponding or approximately corresponding to the width of the gap to be filled up, for example, a metal lath 62, such as illustrated in FIG. 32; possibly, a series of laths 62 with different widths can be provided, from which then, in function of the mutual distance to be realized between the press parts 15, the most suitable lath is selected;

a filling means that adapts to the width of the respective gap;

the lateral edges and/or edges of the press parts 15 can be treated in order to exclude the adhesion of resin, for example, by inclining the lateral edges and/or to provide them with a coating in order to reduce the risk of adhesion, for example, by chromium-plating the lateral edges.

The invention also relates to a device for manufacturing floor panels according to the method set forth above. This device is characterized in that it comprises a press, as well as a press element 14 applicable in the press, said element comprising a plurality of separately formed press parts 15.

The invention also relates to an accessory for manufacturing floor panels according to the method of the invention, with as a characteristic that this accessory consists of a press part, preferably the above-described press part 15, which is intended to form, together with similar press parts, a press element for pressing board-shaped elements into laminate boards for forming floor panels. Preferably, this accessory is a press part that is intended for being attached, together with similar press parts, to a common base element. This accessory or press part preferably is provided with means, more particularly elements, with which it can be coupled to other similar press parts and/or with which it can be applied at a base element, in the latter case preferably in an adjustable manner.

The invention also relates to an accessory for manufacturing floor panels according to the above-described method, characterized in that it consists of at least one base element 16 upon which two or more press parts 15 are provided, a number of which preferably are mutually adjustable.

It also relates to an accessory for manufacturing floor panels, with the characteristic that it substantially consists of a press part for pressing laminate, wherein this press part substantially is made in the shape of a plate, more particularly a plate that, as such, fulfills the press function of a so-called platen, wherein this plate possibly is provided with a relief, and wherein this press part has a surface of less than 3 square meters, and even better of less than 1.5 square meters, and still better of less than 0.5 square meters. More particularly, the press part herein has a surface corresponding to maximum eight floor panels to be manufactured and even better to maximum five, and preferably corresponding to the surface of only one floor panel. Further, it is provided, at its pressing side, with a relief formed at least partially by an etching process. It is noted that such press part possibly also might be applied by itself, in the case that then a small press is applied.

In the represented forms of embodiment, the press elements and press parts 15 are used at the upper side of the press 3. However, it is not excluded to provide such press elements at the lower side, in the case that the board-shaped elements 2 are pressed with their decorative side downward, or to apply such press elements and press parts 15 when board-shaped elements 2 are pressed that are equipped with a decorative side at the upper side as well as at the lower side.

Generally, it is preferable that the aforementioned press parts are chromium-plated. However, the basic material preferably is steel, or an alloy on the basis of steel. The use of other materials, however, is not excluded.

In the case that use is made of press parts 15 that are provided on a base element 16, the press parts 15, for example, can be made of a softer steel than the base element 16. Namely, the tension forces that are created when suspending the whole, substantially are taken up by the base element. Thus, the press parts 15 may then consist of softer steel, which is less expensive and moreover is easier to process.

The use of relatively small press plates 15 allows that these are very easy to handle, in respect to transport as well as when processing them. Thus, such press part is easy to repair in case of a defect, for example, by removing material at the location of the defect, for example, by milling it away, subsequently welding in the same material and re-structuring the surface, for example, by means of a machining treatment and/or etching. It is clear that herein, first a total de-chroming may take place and, after repair, a total chrome-plating may be performed.

The present invention is in no way limited to the forms of embodiment described by way of example and shown in the figures; on the contrary, such method, device and accessories for manufacturing floor panels may be realized in various variations without leaving the scope of the invention.

The invention claimed is:

1. A method for manufacturing floor panels, comprising the steps of:

subjecting board-shaped elements to a press treatment at a decorative side of the board-shaped elements and subsequently dividing said board-shaped elements into a plurality of floor panels at least with a sawing treatment along a plurality of saw lines positioned in between two of said plurality of floor panels;

wherein for said press treatment use is made of a press element having a plurality of separately formed press parts, each of said plurality of press parts being provided with a surface relief extending over a surface of a pressing side of the respective press part and each of said plurality of press parts being plate-shaped;

wherein each of said plurality of press parts has a globally flat pressing side with the exclusion of the surface relief and unevenness, said pressing side being configured to press against said one or more of said plurality of floor panels and including an overhang portion adjacent an end of each of said plurality of press parts; said overhang portion extending beyond a corresponding edge of at least one of said saw lines outside of the floor panel;

wherein the surface of each of said plurality of floor panels is pressed with and has a surface relief formed from only one unitary press part among said plurality of press parts.

2. The method of claim 1, wherein the-surface relief of which is at least formed of unevennesses, which, during pressing, form impressions, said impressions being of one or more types selected from following possibilities:

impressions of the type forming a relief that imitates the natural surface of wood, stone or variants thereof;

impressions of the type imitating removed material portions or deformed portions and more particularly imitating a chamfer, a groove, scraped-off material portions or variants thereof.

3. The method of claim 2, wherein the board-shaped elements show a decor and wherein the relief, the impressions in the board-shaped element, are, respectively, performed at least partially in register with the decor.

4. The method of claim 1, 2 or 3, wherein the surface relief present at the pressing side thereof is realized at least partially by means of an etching process.

5. The method of claim 3, wherein the press element comprises two or more press parts, wherein the mutual position between two or more of these press parts, or thus the location thereof, is adjustable and can be regulated.

6. The method of claim 5, wherein the board-shaped elements are provided with a decor layer consisting of a printed and resin-treated material layer, a printed material sheet, respectively, that originates from a material web with a longitudinal direction and a transverse direction, wherein this material sheet is co-pressed, and wherein the press parts are positioned at mutual locations determined in function of the stretching of the material web.

7. The method of claim 6, wherein this method is applied for manufacturing floor panels from the board-shaped panels according to the DPL principle (Direct Pressure Laminate).

8. The method of claim 6, wherein positioning as a function of the stretching is performed at least according to said transverse direction.

9. The method of claim 8, wherein the positioning in function of the stretching is performed in a transverse direction as well as in a longitudinal direction; wherein for the press element, use is made of at least two base elements situated longitudinally one behind the other each possessing a number of press parts situated next to each other in the transverse direction; and wherein said positioning in the longitudinal direction is realized at least by displacing the base elements with the press parts present thereon more or less away from each other, whilst the positioning in the transverse direction is realized by displacing the press parts as such more or less away from each other.

10. The method of claim 1, wherein the surface relief present at the pressing side thereof is realized at least partially by means of a mechanical machining treatment.

11. The method of claim 1, wherein the press parts are attached to a common base element thereby forming the entirety of the press element.

12. The method of claim 11, wherein the press parts are detachably attached to the base element.

13. The method of claim 1, wherein the press element comprises two or more base elements, at which respectively two or more press parts are provided.

14. The method of claim 1, wherein the location of one or more press parts is adjustable, and can be regulated in respect to the pertaining base element.

15. The method of claim 14, wherein the location is adjustable via means allowing a certain fixed setting.

16. The method of claim 14, wherein the location is adjustable via means allowing a controlled adjustment, wherein the adjustment is controlled as a function of data derived from a decor layer to be pressed.

17. The method of claim 1, wherein a series of two or more press elements is used having identical press parts that are provided at respective base elements in uniform configurations, wherein the press parts are situated at least according to a transverse direction at different distances from each other for the different press elements, the press elements are each arranged for pressing similar material sheets and are stretched differently, wherein the most suitable press element of said series is selected as a function of the stretch.

18. The method of claim 1, wherein said plate-shaped press parts form the entirety of the press element by being attached next to and to each other.

19. The method of claim 18, wherein said press parts are attached next to each other by additional coupling pieces.

20. The method of claim 1, wherein a clearance is formed between adjacent unitary press parts and thereby the overhang portion of adjacent press parts.

21. The method of claim 20, wherein the clearance is formed between the saw lines of adjacent and opposed floor panels.

22. A method for manufacturing floor panels, comprising the steps of:

subjecting board-shaped elements to a press treatment at a decorative side of the board-shaped elements and subsequently dividing said board-shaped elements into a plurality of floor panels at least with a sawing treatment along a plurality of saw lines positioned in between two of said plurality of floor panels;

wherein for said press treatment use is made of a press element having a plurality of separately formed press parts, each of said plurality of press parts being provided with a surface relief extending over a surface of a pressing side of the respective press part and each of said plurality of press parts being plate-shaped;

wherein each of said plurality of press parts has a globally flat pressing side with the exclusion of the surface relief and unevenness, said pressing side being configured to press against said one or more of said plurality of floor panels and including an overhang portion adjacent an end of each of said plurality of press parts; said overhang portion extending outside of the panel and beyond an upper edge at a location corresponding to coupling means of a definitive floor panel;

wherein the surface of each of said plurality of floor panels is pressed with and has a surface relief formed from only one unitary press part among said plurality of press parts.

* * * * *